US010301807B1

(12) United States Patent
Kolesar

(10) Patent No.: US 10,301,807 B1
(45) Date of Patent: May 28, 2019

(54) TOILET COVERS AND SKIRTS, AND ACCESSORIES RELATED TO USING THE SAME IN, ON AND/OR AROUND A TOILET

(71) Applicant: Stephen Charles Kolesar, Alpharetta, GA (US)

(72) Inventor: Stephen Charles Kolesar, Alpharetta, GA (US)

( * ) Notice: Subject to any disclaimer, the term of this patent is extended or adjusted under 35 U.S.C. 154(b) by 0 days.

(21) Appl. No.: 16/103,205

(22) Filed: Aug. 14, 2018

Related U.S. Application Data

(60) Provisional application No. 62/547,288, filed on Aug. 18, 2017, provisional application No. 62/678,144, filed on May 30, 2018.

(51) Int. Cl.
*E03D 9/00* (2006.01)
*A47K 13/26* (2006.01)

(52) U.S. Cl.
CPC ..... *E03D 9/00* (2013.01); *A47K 13/26* (2013.01)

(58) Field of Classification Search
CPC ..... E03D 9/00
USPC ..... 4/300.3
See application file for complete search history.

(56) References Cited

U.S. PATENT DOCUMENTS 1,573,619 A * 2/1926 Lemmer ..... A47K 13/16 220/DIG. 21
4,010,497 A 3/1977 Menter et al.
4,069,522 A * 1/1978 Messmer ..... A47K 11/04 4/483
4,705,050 A 11/1987 Markham
4,720,880 A * 1/1988 Barreau ..... A47K 13/14 383/907
4,979,237 A * 12/1990 Hazar ..... A47K 17/003 4/244.1
5,067,185 A * 11/1991 Kohler ..... A47K 13/16 4/245.1
5,088,132 A 2/1992 Walka
5,745,929 A * 5/1998 Sobieralski ..... A47K 13/18 383/207
6,081,937 A 7/2000 Whitacre
6,174,581 B1 1/2001 Barker
6,305,034 B1 * 10/2001 Perez Urrutia ..... A47K 17/00 4/144.2
6,374,428 B1 4/2002 Copeland et al.
6,564,399 B1 * 5/2003 Teal ..... A47K 11/105 4/300.3

(Continued)

*Primary Examiner* — Lori L Baker
(74) *Attorney, Agent, or Firm* — Alston & Bird LLP

(57) ABSTRACT

Devices and assemblies that improve hygiene in, on, and around a toilet through positioning and use of toilet covers and skirts that can be attached to the inside, on, and/or around the toilet bowl rims and other interior and exterior surfaces of the toilet and the bottom surface of the toilet seat are described. These internal and external surfaces would otherwise be exposed to splatter and direct impact of urine. The materials, structures and configurations of the covers and skirts, including coatings and textures, impregnations and layers, as well as the various attachment methods, devices, apparatus and dispensers improve the efficiency and efficacy of the hygiene and sanitation of the toilet cleaning process by minimizing handling and exposure to biological contamination via rapid and minimal contact removal and disposal of the urine contaminated covers, the rapid attachment of the new covers and the pre-covering of difficult to clean regions.

28 Claims, 45 Drawing Sheets

(56) References Cited

U.S. PATENT DOCUMENTS

| | | | | |
|---|---|---|---|---|
| 8,112,828 | B1 | 2/2012 | Varela, III | |
| 9,487,939 | B1 | 11/2016 | Cook | |
| 2003/0208836 | A1* | 11/2003 | Bankemper | A47K 13/14 4/245.1 |
| 2004/0093663 | A1 | 5/2004 | Zhu | |
| 2007/0039089 | A1 | 2/2007 | Worrel | |
| 2010/0024110 | A1* | 2/2010 | St. John | E03D 9/00 4/300.3 |
| 2011/0271433 | A1* | 11/2011 | Aspiro | A47K 13/16 4/245.1 |
| 2012/0146371 | A1* | 6/2012 | Cotton | A47C 31/11 297/219.1 |
| 2012/0246811 | A1* | 10/2012 | Sayre | A47K 13/16 4/245.1 |
| 2013/0219605 | A1* | 8/2013 | Grover | E03D 11/08 4/300.3 |
| 2014/0101835 | A1* | 4/2014 | Notman | E03D 9/00 4/300.3 |
| 2014/0223655 | A1* | 8/2014 | Dillard | A47K 13/04 4/300.3 |
| 2015/0083637 | A1* | 3/2015 | Rosario | A47K 13/16 206/581 |
| 2016/0237669 | A1* | 8/2016 | Mullens | E03D 9/00 |

* cited by examiner

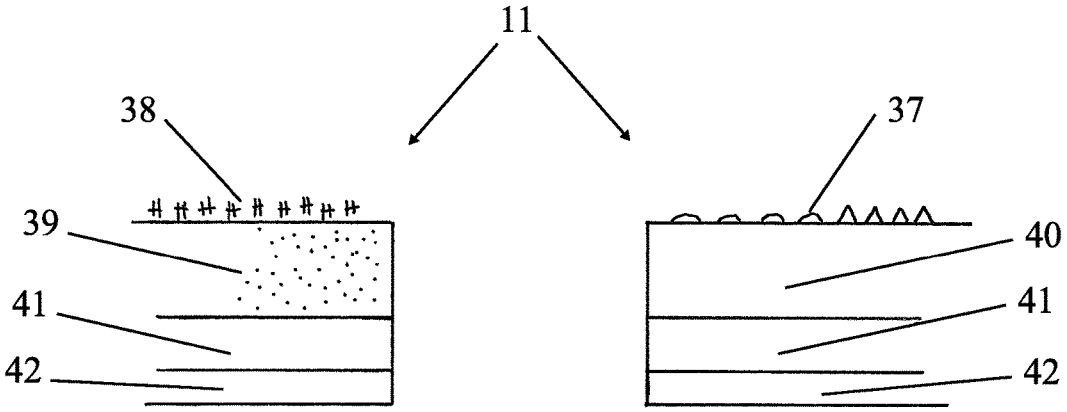
FIG. 48A
FIG. 48B
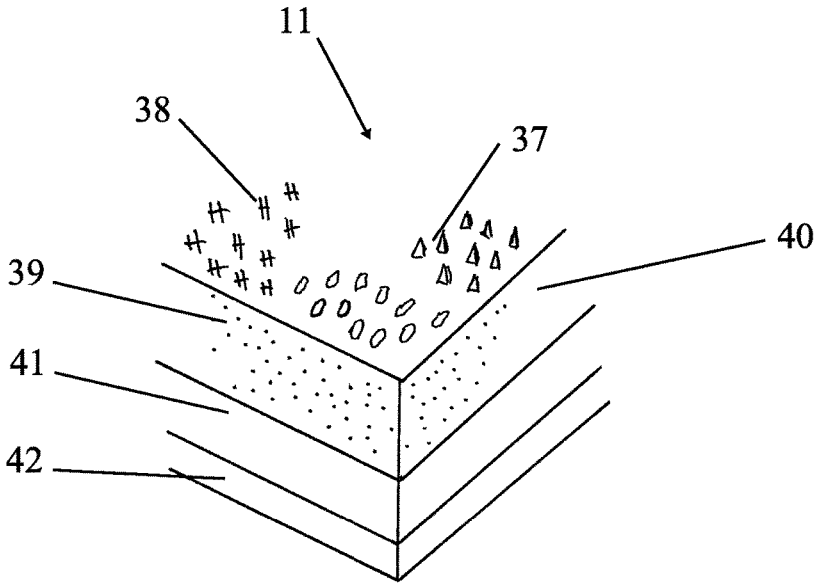
FIG. 49

TOILET COVERS AND SKIRTS, AND ACCESSORIES RELATED TO USING THE SAME IN, ON AND/OR AROUND A TOILET

CROSS REFERENCE TO RELATED APPLICATIONS

This application claims priority to and the benefit of U.S. Provisional Patent Application No. 62/547,288, filed Aug. 18, 2017, and U.S. Provisional Patent Application No. 62/678,144, filed May 30, 2018; the contents of both of which as are hereby incorporated by reference in their entireties.

BACKGROUND

Related Field

The present invention relates to toilet covers and skirts, and accessories related to attaching or otherwise positioning the same on the toilet, primarily for use in household, small business and public-access bathroom facilities, bathrooms and restrooms with traditional horizontal flush toilets, and the like, as compared with public larger-scale bathrooms primarily having multiple vertically mounted urinals and/or trough-style urinals.

Description of Related Art

Sanitation and hygiene in, on and around toilets and/or toilet assemblies have traditionally involved several approaches: The first concerns the "user's" health. The prime example being the use of toilet seat covers in public toilet facilities. The covers, placed upon the top surface of the toilet seat, are intended to form a barrier between the User and the toilet seat, which could have been used by multiple users between cleaning procedures. The covers are intended to reduce the transmission of toilet seat top surface contamination from one user to the next user. Exemplary prior art related to this approach includes U.S. Pat. Nos. 4,979,237 and 5,745,929. These references are described, in turn, immediately below.

U.S. Pat. No. 4,979,237 (1990) teaches that there existed a need for an effective sanitary protector for toilet seats, particularly public toilet seats, which protectors are disposable and will remain in proper position on the toilet seat during use. This patent also includes an optional dispenser and waste receptacle for the used cover. This patent teaches that the top surface covers are used with the toilet seat and the user in the lowered, horizontal sitting position. This patent does not teach generally or specifically for toilet covers whose purpose is to collect/absorb urine and/or excrement spatter on the toilet bowl rim surfaces beneath the toilet seat; on the bottom surface of the toilet seat; on the toilet seat and lid hinge areas; or on the other interior and/or exterior toilet bowl surfaces. This patent does not teach generally or specifically for the toilet seat and/or the user to be primarily in the vertical/standing position during use.

U.S. Pat. No. 5,745,929 (1998) teaches that toilet seat covers, such as used in public restrooms, were deemed inadequate in size, shape and composition, and provided inadequate protection against transmission of disease. This patent teaches that the toilet seat cover be flexible, non-porous and large enough to tuck portions of the cover material underneath the seat to secure the toilet seat cover. This patent also teaches in one embodiment that the toilet seat cover may be in a bag shape with a cord that can be pulled to tighten and further secure the bag shaped toilet seat cover underneath the toilet seat. This patent does not teach generally or specifically for toilet covers whose purpose is to collect/absorb urine and/or excrement spatter on the toilet bowl rim surfaces beneath the toilet seat; on the toilet seat and lid hinge areas; or on the other interior and/or exterior toilet bowl surfaces. This patent does not teach generally or specifically for the toilet seat and/or the user to be primarily in the vertical/standing position during use.

The second approach to toilet sanitation and hygiene involves the use of various products, structures and/or devices placed inside the toilet bowl on, or just under, the water surface. These items are designed to minimize urine and fecal matter splash and spatter within and about the toilet bowl. Exemplary prior art related to this approach includes U.S. Pat. Nos. 6,081,937; 6,564,399; 8,112,828; and 9,487,939, along with United States Publication Nos. 2004/0093663 and 2007/0039089. These references are described, in turn, immediately below.

U.S. Pat. No. 6,081,937 (2000) teaches an apparatus for absorbing the impact of a stream of liquid entering a body of liquid so as to minimize splash. In particular, an apparatus capable of floating substantially upon the surface of the body of water, that may be used advantageously within a standard commode bowl to minimize or eliminate the amount of splash caused by a stream of urine impacting the body of water contained within the commode bowl. This patent does not teach generally or specifically for covers whose purpose is to collect/absorb urine spatter on the toilet bowl rim surfaces; on the toilet seat and lid hinge areas; or on the exterior toilet bowl surfaces.

U.S. Pat. No. 6,564,399 B1 (2003) teaches a flushable bowl protecting liner for reducing the need for manual cleaning by providing a barrier between the bowl of the toilet and solid waste. The liner includes a barrier material that is flat and rigid when dry and rendered flexible when in contact with water. The liner is set into the toilet bowl above the water level and as solid waste is deposited onto the material it wraps about the waste. This patent does not teach generally or specifically for covers whose purpose is to collect/absorb urine spatter on the toilet bowl rim surfaces; on the toilet seat and lid hinge areas; or on the exterior toilet bowl surfaces.

United States Patent Application Pub. No. US 2004/0093663 A1 (2004) teaches a splash prevention paper that floats on and covers the major portion of the water surface in the toilet bowl to suppress the splash of soil water when the feces fall into the toilet bowl. This patent does not teach generally or specifically for covers whose purpose is to collect/absorb urine spatter on the toilet bowl rim surfaces; on the toilet seat and lid hinge areas or on the exterior toilet bowl surfaces. This patent does not teach generally or specifically for the toilet seat and/or the user to be primarily in the vertical/standing position during use.

United States Patent Application Pub. No. US 2007/0039089 A1 (2007) teaches a noise and splash attenuation device for use in a standard toilet fixture with a liquid filled bowl utilizing a planar sheet on the surface of the water in the toilet bowl. Various embodiments include transmitting the debris through the sheet, a foam producing agent, and elongated structures within the toilet fixture, providing a transmission network for transmitting the falling liquid to the liquid surface through the elongated structures for attenuating the noise and splash emitted from any falling debris upon contact with the liquid surface. This patent does not teach generally or specifically for covers whose purpose is to collect/absorb urine spatter on the toilet bowl rim surfaces; on the toilet seat and lid hinge areas; or on the exterior toilet bowl surfaces.

U.S. Pat. No. 8,112,828 B1 (2012) teaches a toilet anti-splatter apparatus which limits urine splash in a toilet. The apparatus is provided in a plurality of sheets, wherein each sheet provides a floating target with bulls eye containing a foaming agent which diminishes splatter. This patent does not teach generally or specifically for covers whose purpose is to collect/absorb urine spatter on the toilet bowl rim surfaces; on the toilet seat and lid hinge areas; or on the exterior toilet bowl surfaces.

U.S. Pat. No. 9,487,939 B1 (2016) teaches a pre-moistened (wet) with surfactant and humectant, flushable, toilet bowl liner shield for use in a flushable toilet wherein the water has an upper surface. The upper surface of the flat liner sits directly on top or slightly under the upper surface edge of the water. The liners reduce or prevent soiling of the interior of a toilet bowl and for efficient removal and flushing of human waste. This patent does not teach generally or specifically for covers whose purpose is to collect/absorb urine spatter on the toilet bowl rim surfaces; on the toilet seat and lid hinge areas; or on the exterior toilet bowl surfaces.

The third and the most common approach to toilet bowl sanitation and hygiene involves 'after the fact' use of various cleaning and sanitizing products, implements, tools and devices. These are well known and in general use and they may or may not be proprietary. They are not specific to the intent or claims of this patent application.

Still further, the use of dry, disposable toilet seat covers is known in the prior art for use predominantly on public toilet seats as a means to reduce the transfer of biological contamination from the public toilet seat to the current user. Prior to use, the user places the cover on the top surface of the toilet seat while the toilet seat is in the horizontal, sitting position. The covers come pre-packaged and pre-cut to generic public toilet seat shapes and sizes, with or without the inner section cut out or perforated for removal by the user. The covers are not used, and are not intended for use, when the toilet seat is in the vertical position. They are not intended for use to cover the toilet bowl rims, seat bottom surfaces, the toilet seat and lid hinge areas; or other interior and exterior surfaces and structures of the toilet assembly. Generically, the covers are made of thin paper-type material; without an adhesive on the bottom surface; without enhanced coatings on the upper surface, impregnations or defined layers; are not attached by any devices or structures, but are single-use and are disposable and/or flushable.

Additional exemplary and known prior art references are detailed, in turn below.

U.S. Pat. No. 4,010,497 (1977) teaches that when the surface of the water contained in a commode is disturbed by the deposition of excreted materials, the resulting effect is a splash. The splash can spread the water contained therein so that said water comes into contact with the skin of the person using the commode. In as much as the water so spread has been in contact with germ-containing human urine and fecal matter, it can and does have a high risk of spreading disease. This patent teaches that a disposable, biodegradable paper on the surface of the water which eliminates the splash which results from the deposition of urine and fecal matter on the surface of the commode. This patent does not teach generally or specifically for toilet covers whose purpose is to collect/absorb urine and/or excrement spatter on the toilet bowl rim surfaces; on the bottom surface of the toilet seat; on the toilet seat and lid hinge areas; or on the exterior toilet bowl surfaces. This patent does not teach generally for the toilet seat and/or the user to be primarily in the vertical/standing position during use.

U.S. Pat. No. 5,088,132 (1992) teaches that toilets are typically without any provision for containing splashes of urine or other liquids and preventing such liquids from contact wall surfaces adjacent to the toilet, resulting in the walls adjacent to the toilet becoming malodorous. This invention generally relates to splash shield devices, in particular to a shield device for protecting surfaces adjacent to a toilet from splashes of urine and other liquids.

U.S. Pat. No. 6,174,581 B1 (2001) teaches a moisture absorbing toilet skirt (pad) that is placed around a toilet bowl base with the purpose of reducing accumulated moisture that is unsightly, smelly and unsanitary. This patent does not teach generally or specifically for covers whose purpose is to collect/absorb urine spatter on the toilet bowl rim surfaces; on the toilet seat and lid hinge areas; or on the other interior and/or exterior toilet bowl surfaces.

BRIEF SUMMARY

The present invention utilizes an innovative, multi-faceted and comprehensive approach to toilet bowl hygiene and sanitation, which is distinct from the previous approaches, but can be used independently or in conjunction with any or all of the existing approaches to toilet hygiene and sanitation previously and/or currently utilized.

The materials, structures and configurations of the covers and skirts, including surface coatings, textures, impregnations, layers and adhesives, as well as the various attachment methods, devices, apparatus and dispensers improve the efficiency and efficacy of the hygiene and sanitation of the toilet cleaning process by minimizing handling and exposure to biological contamination via rapid and minimal contact removal and disposal of the urine contaminated covers; the rapid attachment of the new covers; the pre-covering of difficult to clean regions; and possibly by the increased frequency of the cleaning process.

Informing the above, it is known that toilet bowls and their associated components are typically used in harsh environments. These environments can include water, abrasive and toxic cleaners, as well as excremental matter. Accordingly, toilet bowls and their associated components preferably are made of impervious, noncorrosive materials and should be protected as much as possible, especially the working components.

It is also preferable that all undesirable matter from these environments be confined within the toilet bowl so that the surrounding floor, walls, woodwork, or carpeting is not damaged. This is especially important when harsh chemicals are used that are frequently sprayed from a container and can easily end up outside the toilet bowl. It is also important in households where children frequent the toilet since urine is inevitably sprayed around the hinge area, eventually landing on the floor, walls and other areas.

Additionally, although some areas of the toilet bowl are easily accessible for cleaning, the rear of the top rim of the toilet bowl, where the toilet seat and lid are hinged, is somewhat more difficult to clean. Cleaning of this area is inhibited, even with a specially designed sponge, brush, or similar article. Thus, dirt, urine, and other foreign matter more readily accumulates in this area. Similarly, this is the case in the region of the toilet bowl base where the bolts or other fasteners are used to secure the toilet bowl assembly to the floor. All of this is generally undesirable, but unsolvable in a comprehensive, efficient and cost-effective manner prior to Applicant's own inventive concepts described herein.

Specifically, according to various embodiments, there is provided an assembly configured for protecting multiple portions of a toilet assembly from contaminants, such as urine. The assembly comprises: a flexible rim cover; a first mounting assembly positioned adjacent a portion of the flexible rim cover and a rim portion of the toilet assembly, the first mounting assembly being configured to selectively attach and secure at least a portion of the flexible rim cover to the rim portion of the toilet assembly; a flexible skirt; and a second mounting assembly positioned adjacent a portion of the flexible skirt and a base portion of the toilet assembly, the second mounting assembly being configured to selectively attach and secure at least a portion of the flexible skirt to the base portion of the toilet assembly.

According to still further various embodiments, methods of using the described assembly are also provided. These methods may include the step of dispensing at least the first flexible rim cover from a dispenser mounted to a toilet assembly, such that certain portions of the cover are selectively attached relative to at least a first mounting assembly. The methods may also include the step of dispensing (i.e., selectively removing, for example, by pulling) a flexible skirt from a dispenser mounted to the toilet assembly. In at least one embodiment, a single dispenser may be provided. In other embodiments, no dispensers may be provided, whereby instead the assembly may be retrievable from another location (i.e., a wall-mount dispenser or the like) for placement upon a rim of the toilet assembly. The methods in such embodiments may involve punching out or removing certain elements of the rim cover and/or skirt prior to use thereof, for example, via perforated and/or fold lines pre-formed on the assembly.

Additionally, according to various embodiments, there is provided a pre-formed blank that is configured to be formed—by a user—into the assembly described elsewhere herein. The blank may in certain embodiments include a plurality of any combination of perforations, score lines, fold lines, or the like, such that a user of the assembly is able to selectively remove different elements of the blank to arrive at the assembly, namely the flexible rim cover and/or skirt, along with various aspects thereof, as detailed elsewhere herein.

BRIEF DESCRIPTION OF THE FIGURES

Figure 1:
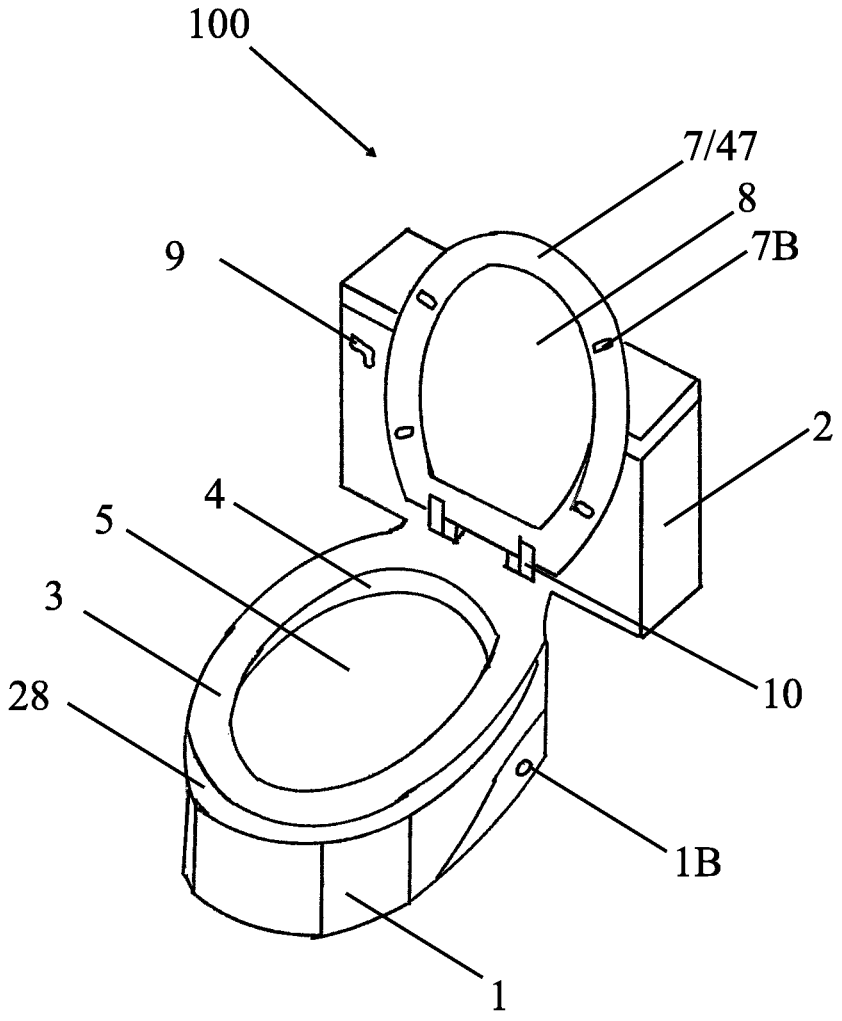
Figure 2:
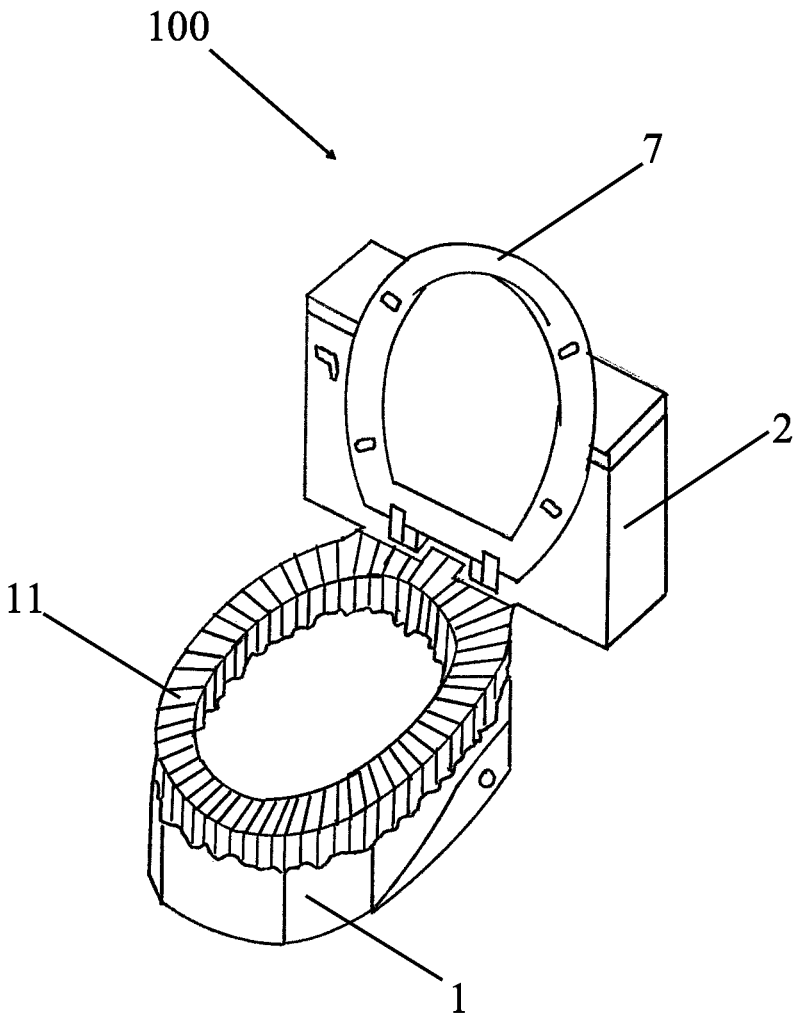
Figure 3:
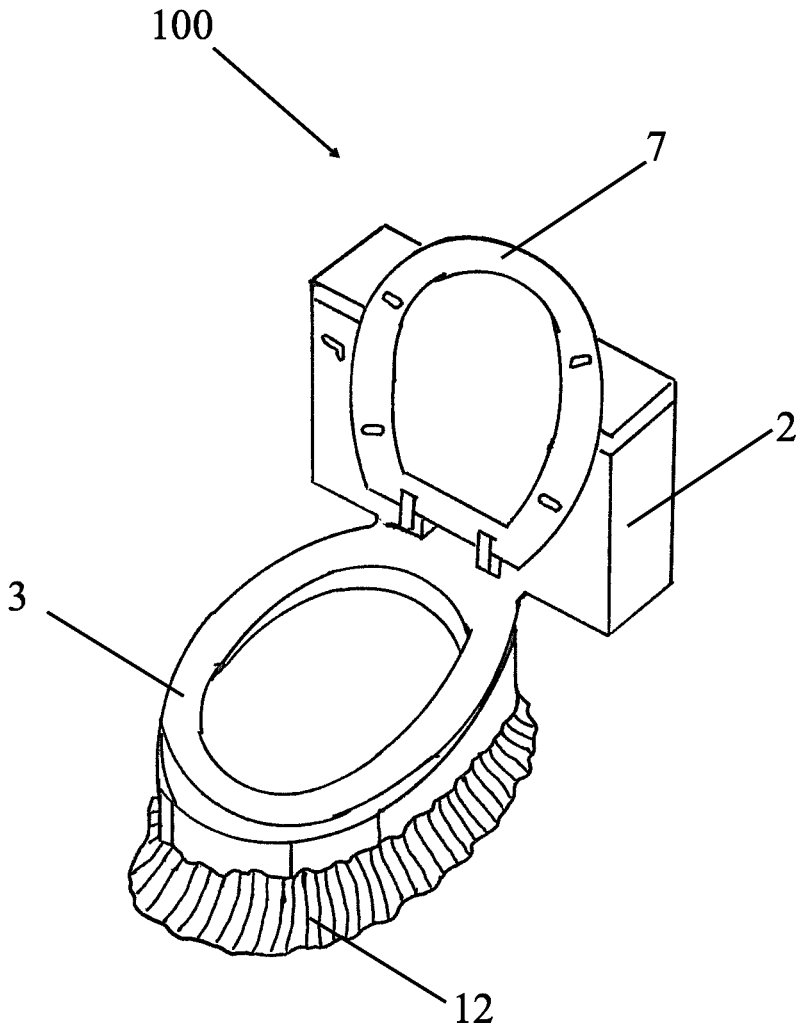
Figure 4:
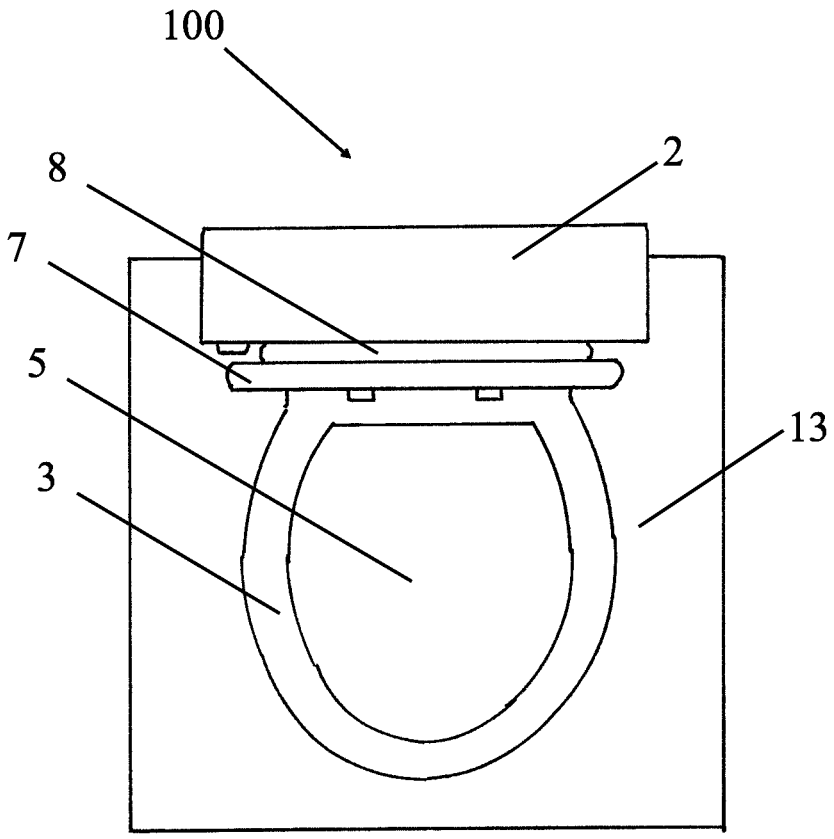
Figure 5:
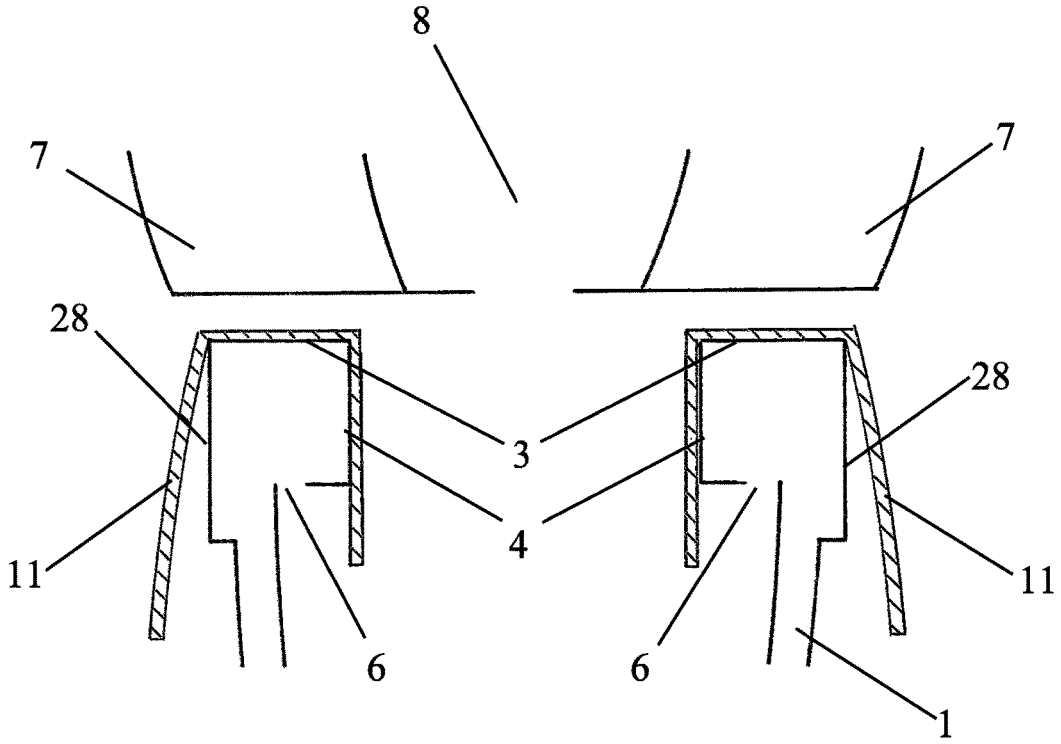
Figure 6:
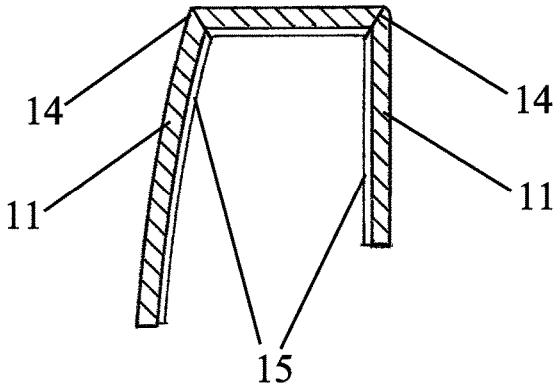
Figure 7:
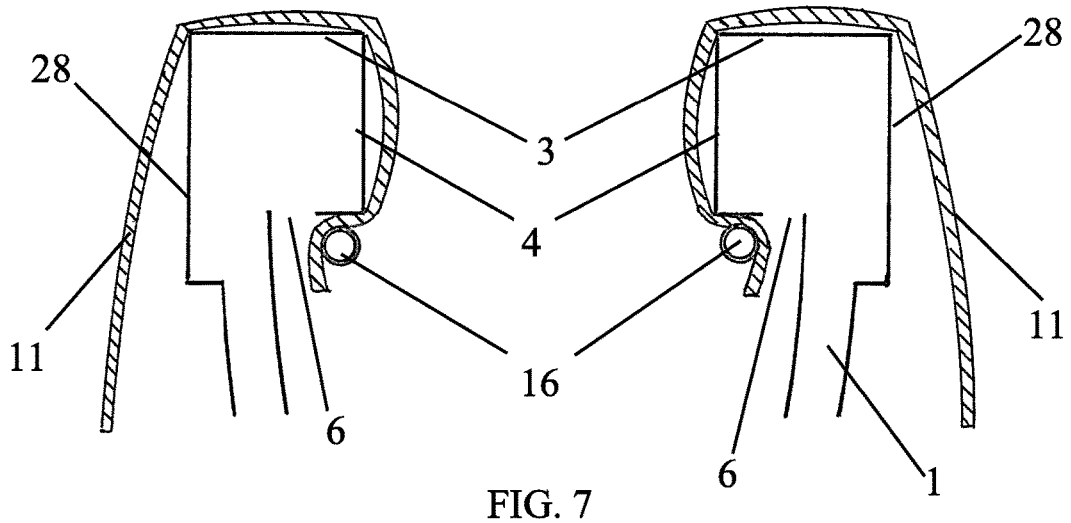
Figure 8:
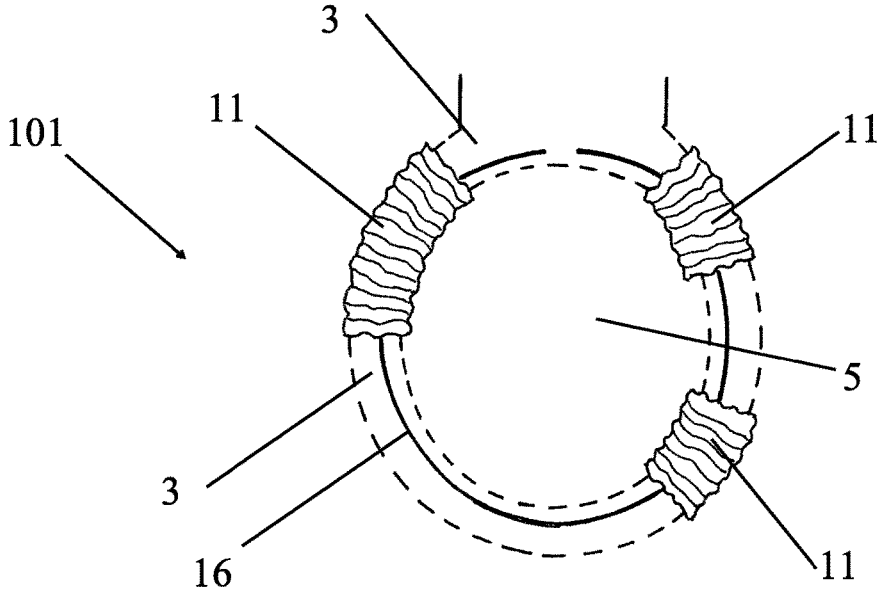
Figure 9:
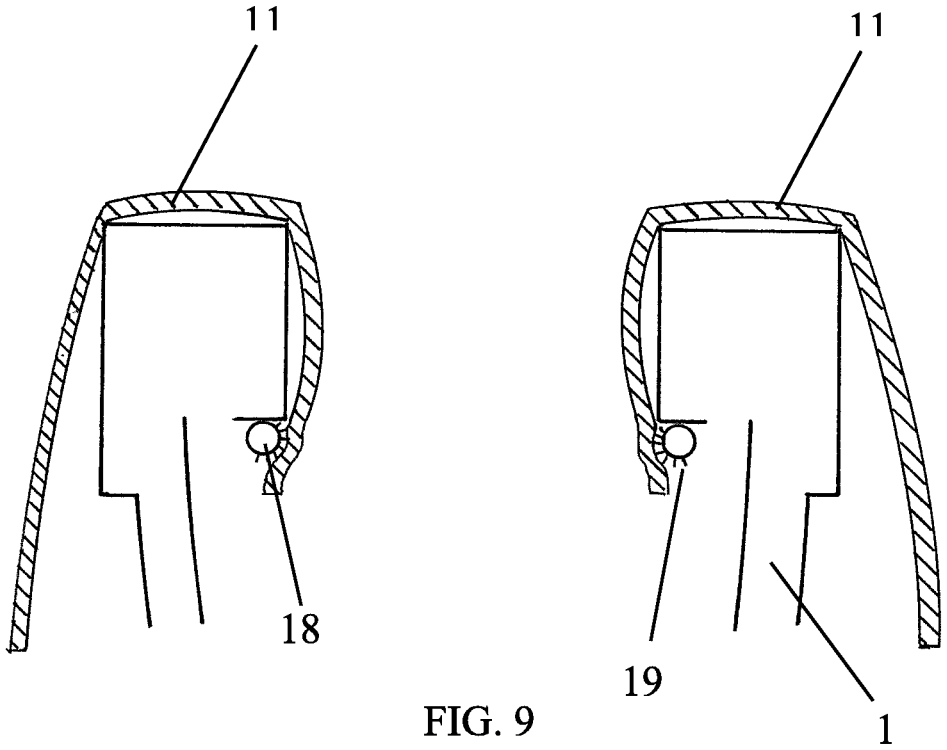
Figure 10:
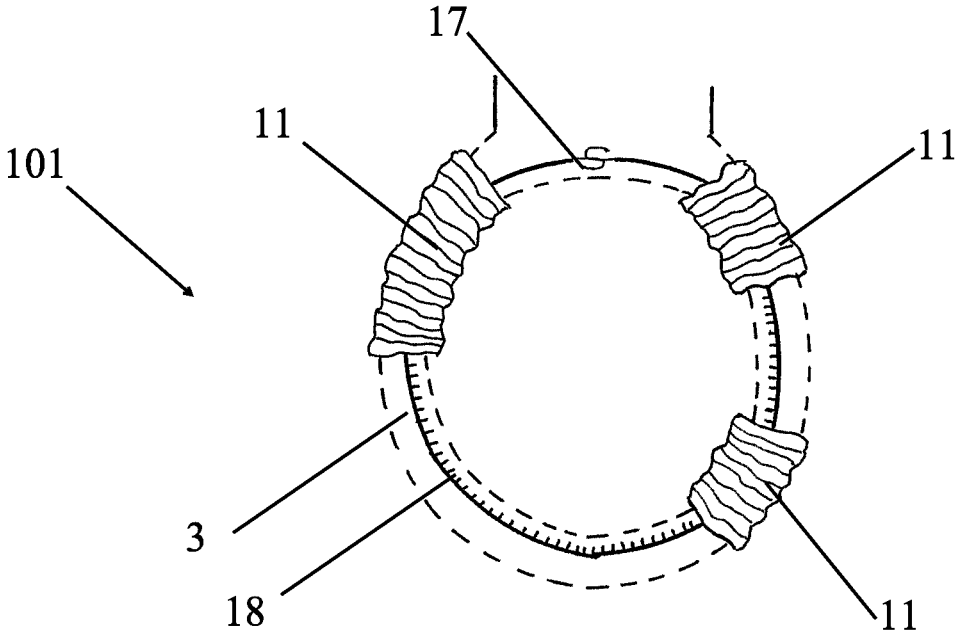
Figure 11:
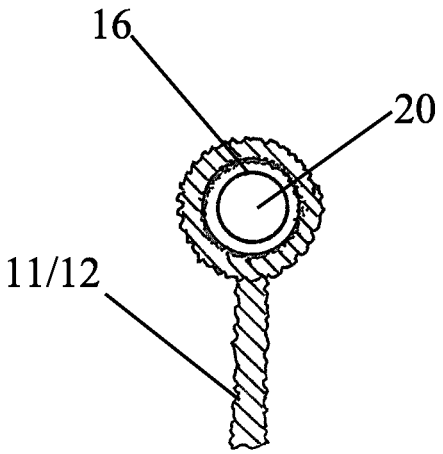
Figure 12:
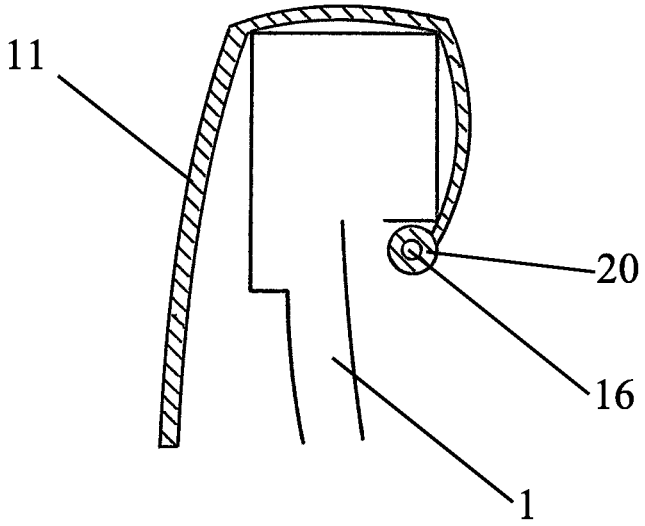
Figure 13:
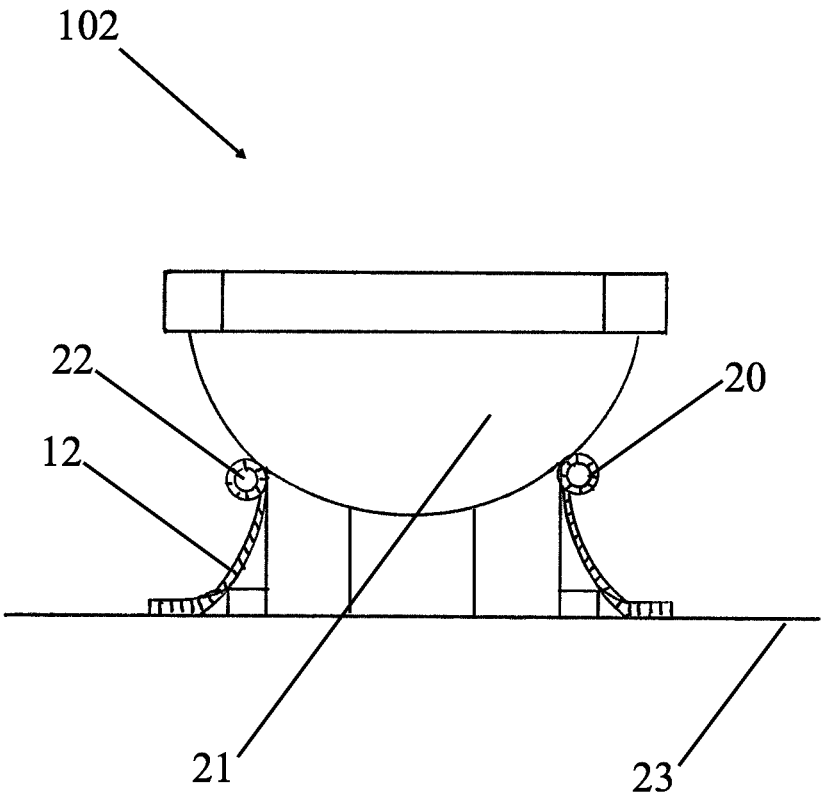
Figure 14:
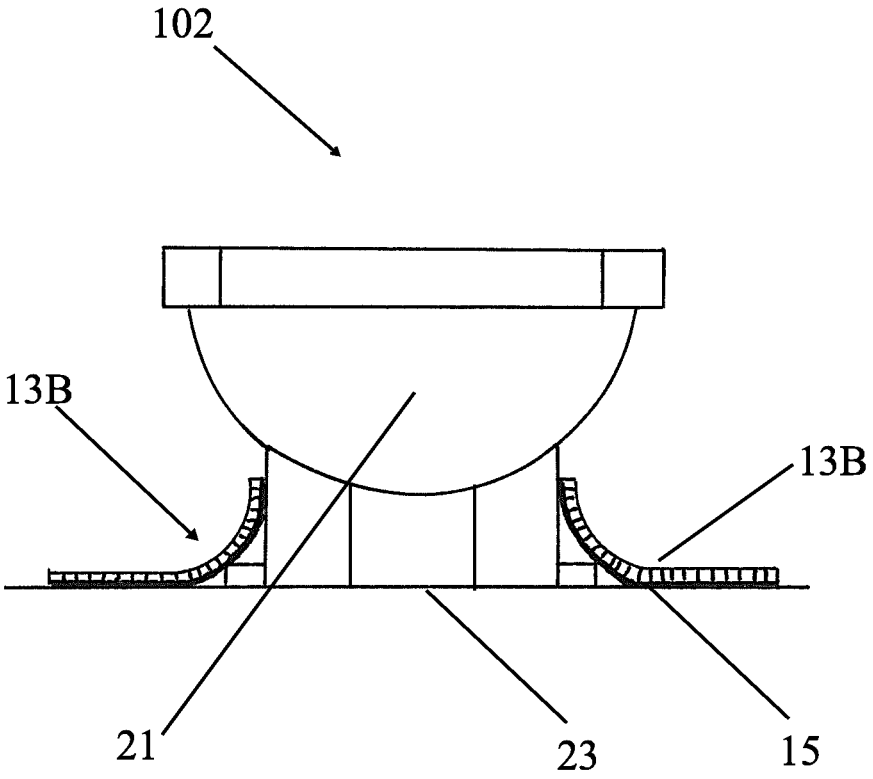
Figure 15:
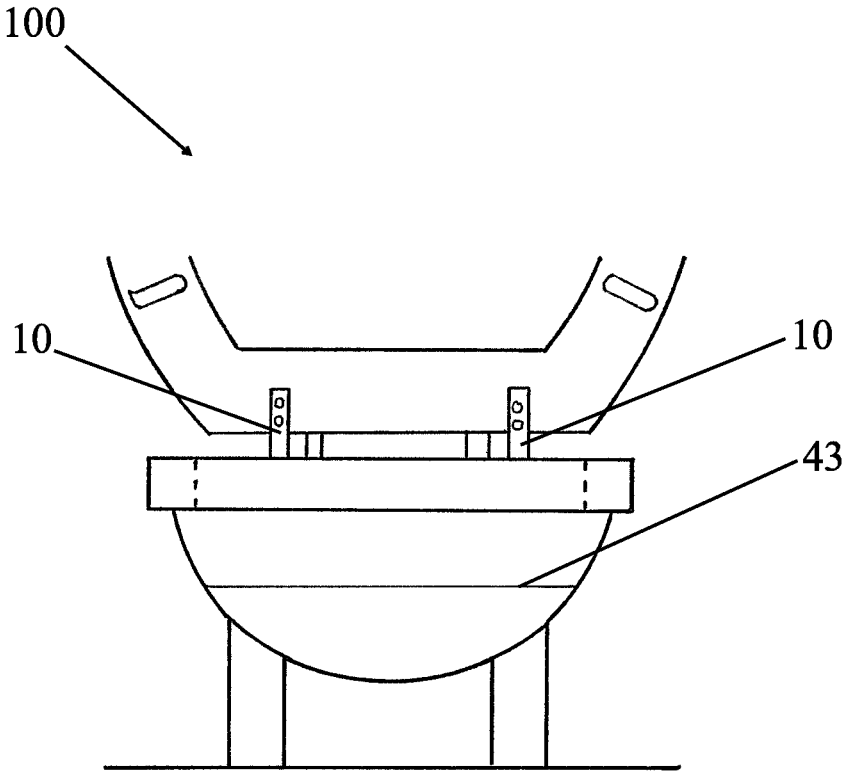
Figure 16:
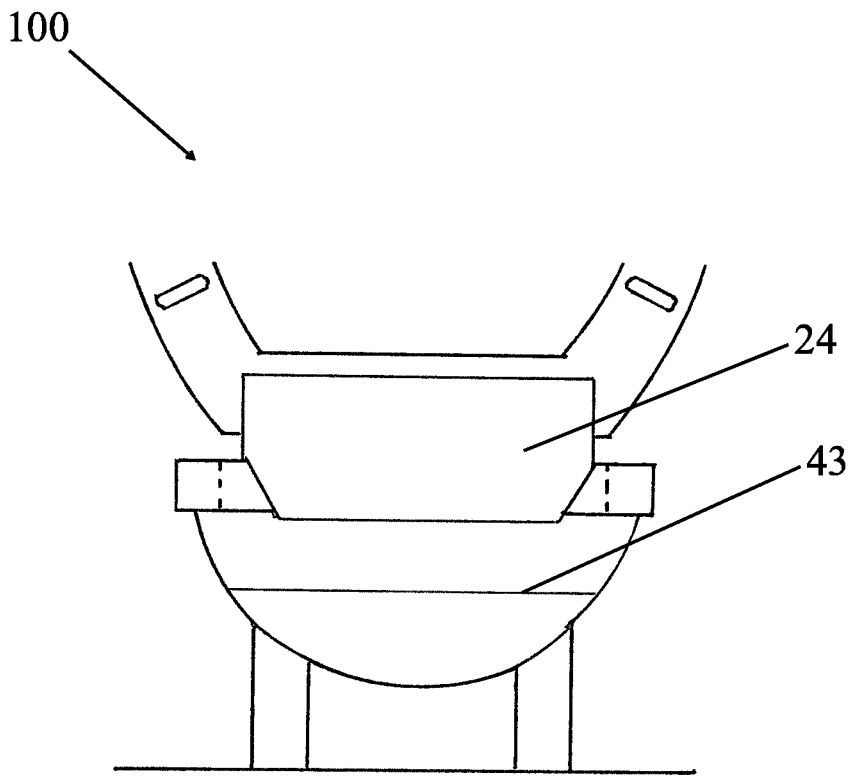
Figure 17:
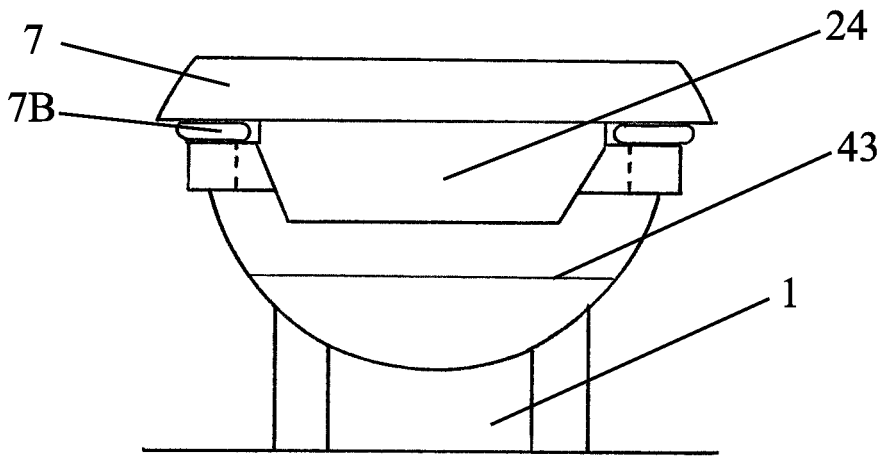
Figure 18:
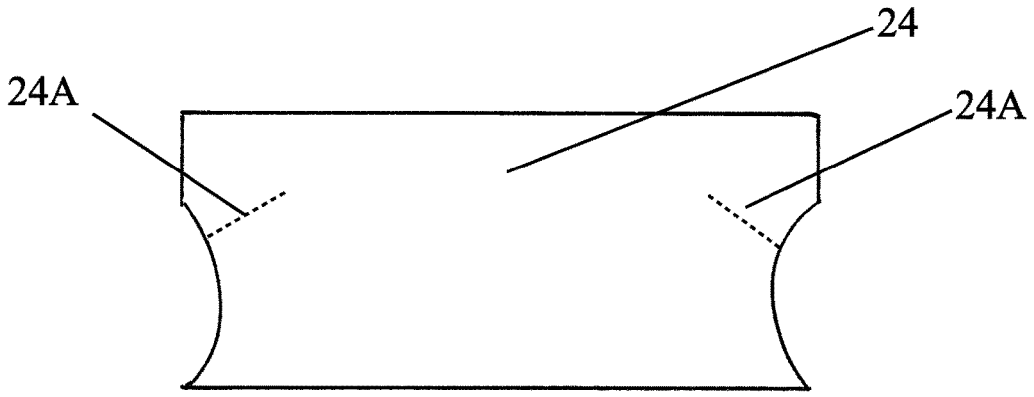
Figure 19:
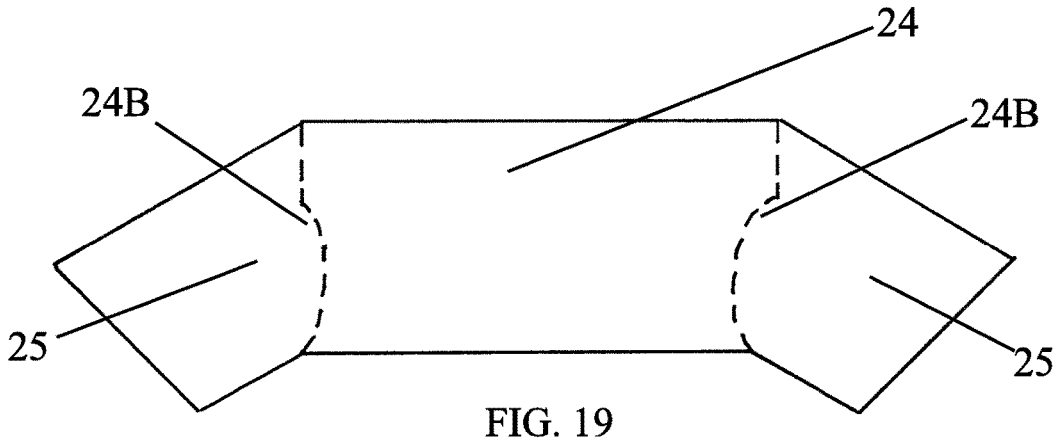
Figure 20:
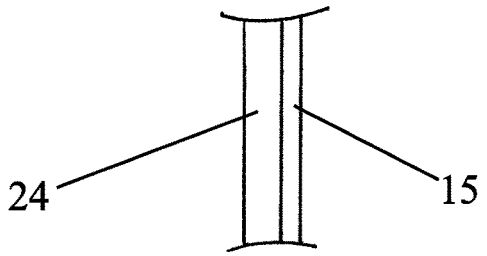
Figure 21:
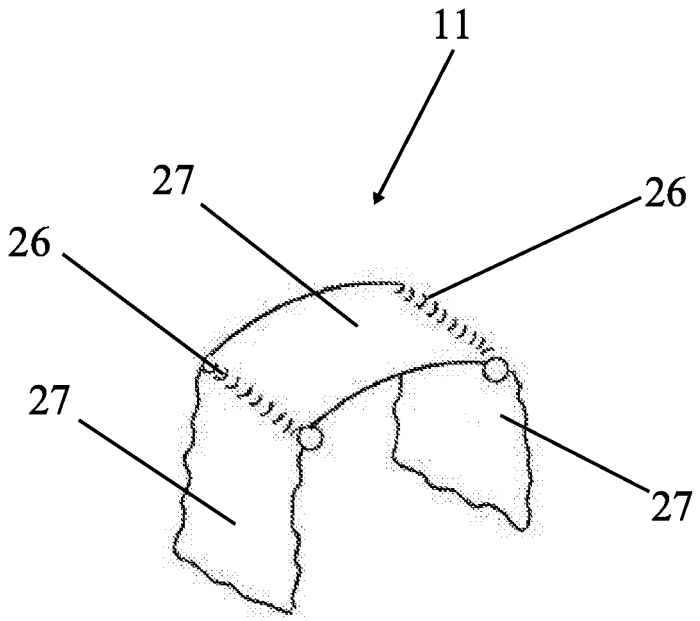
Figure 22:
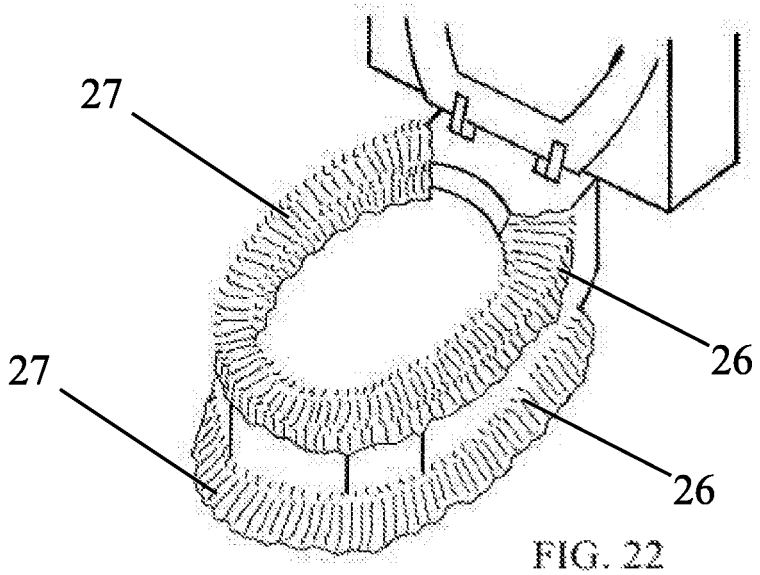
Figure 23:
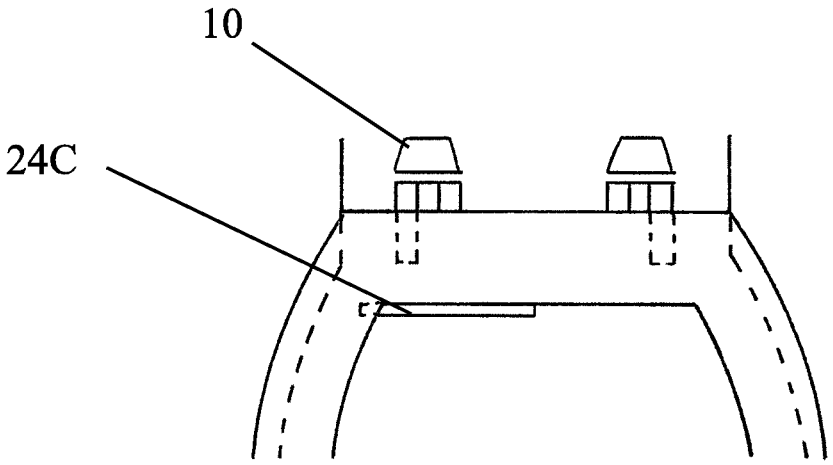
Figure 24:
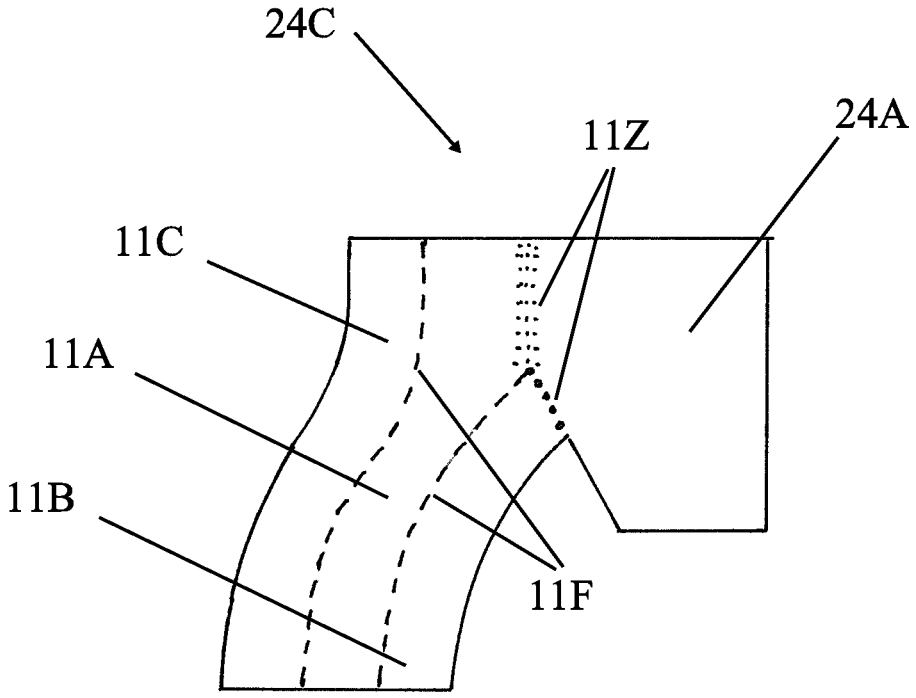
Figure 25:
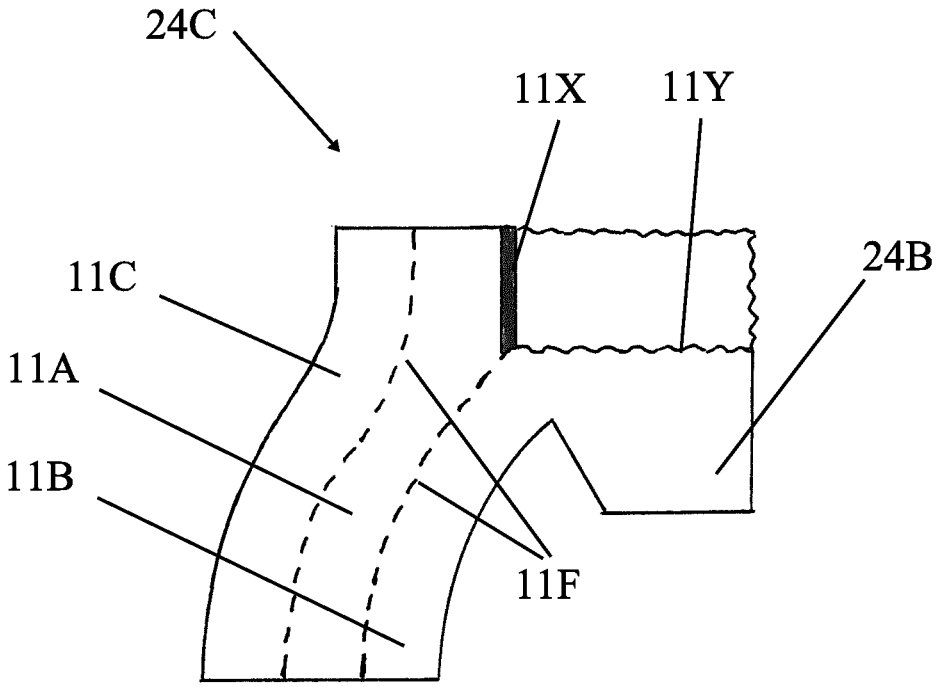
Figure 26:
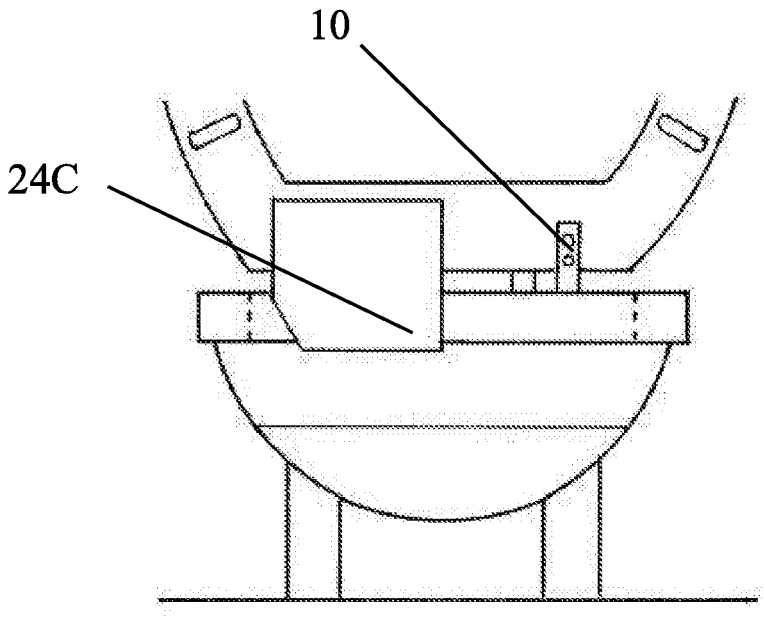
Figure 27:
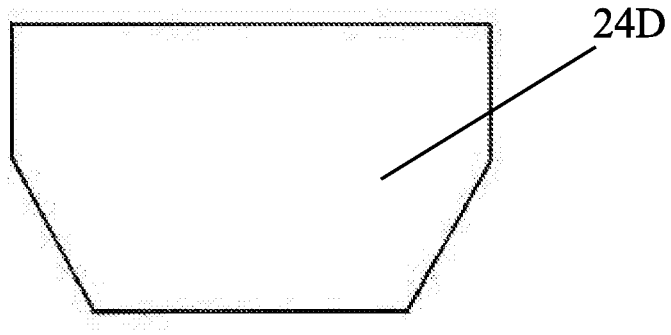
Figure 28:
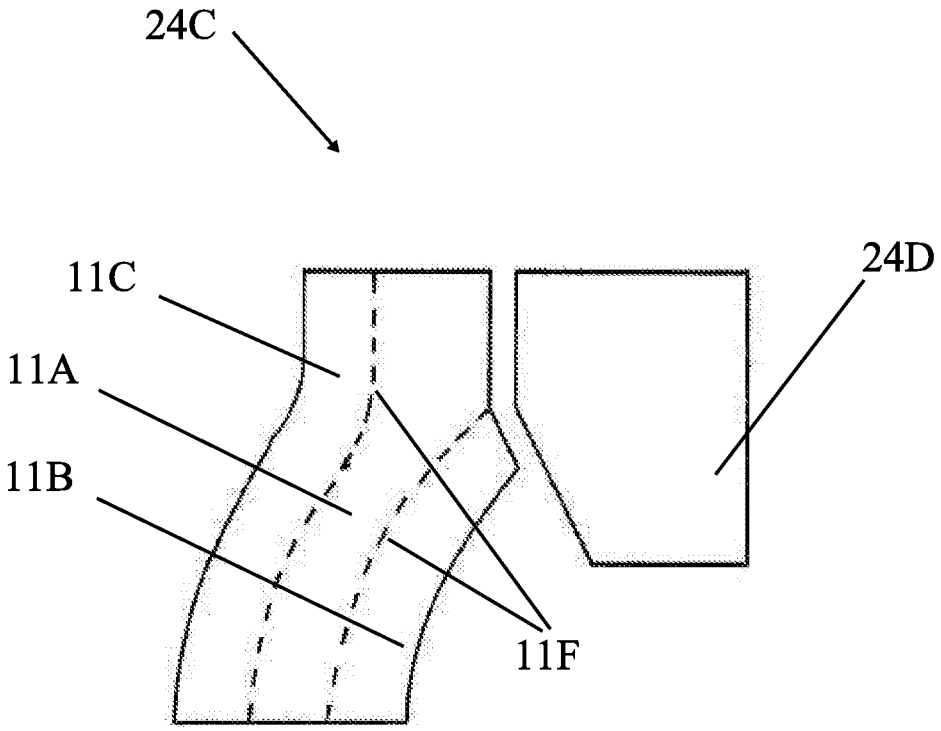
Figure 29:
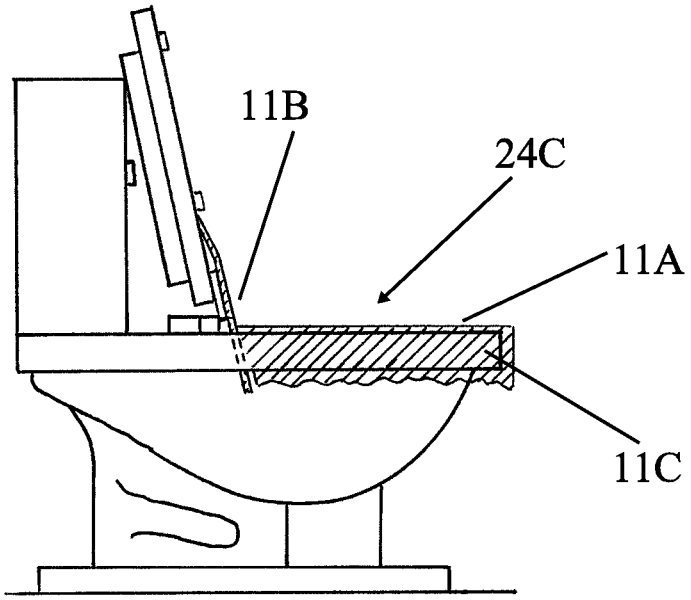
Figure 30:
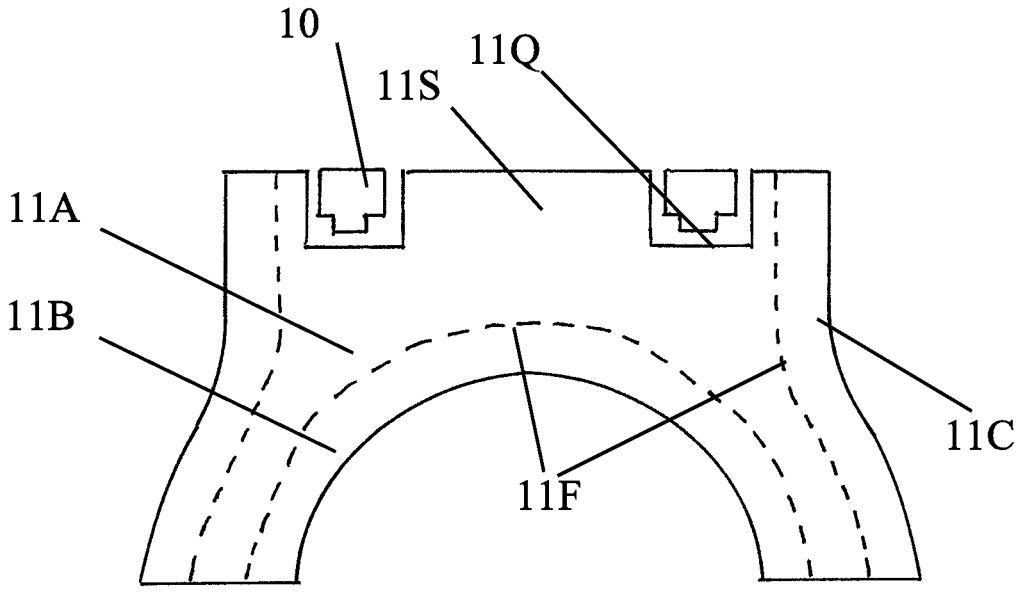
Figure 31:
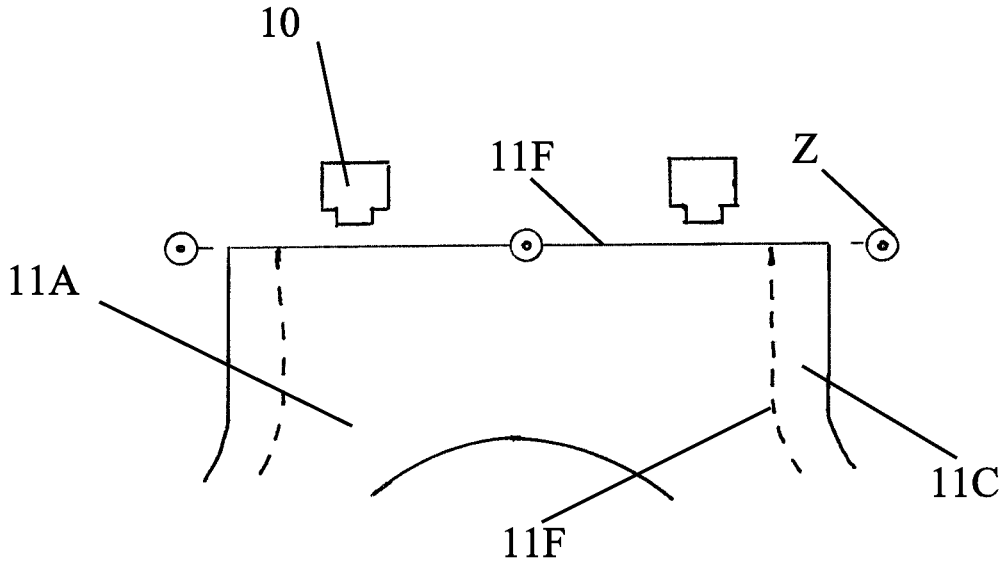
Figure 32:
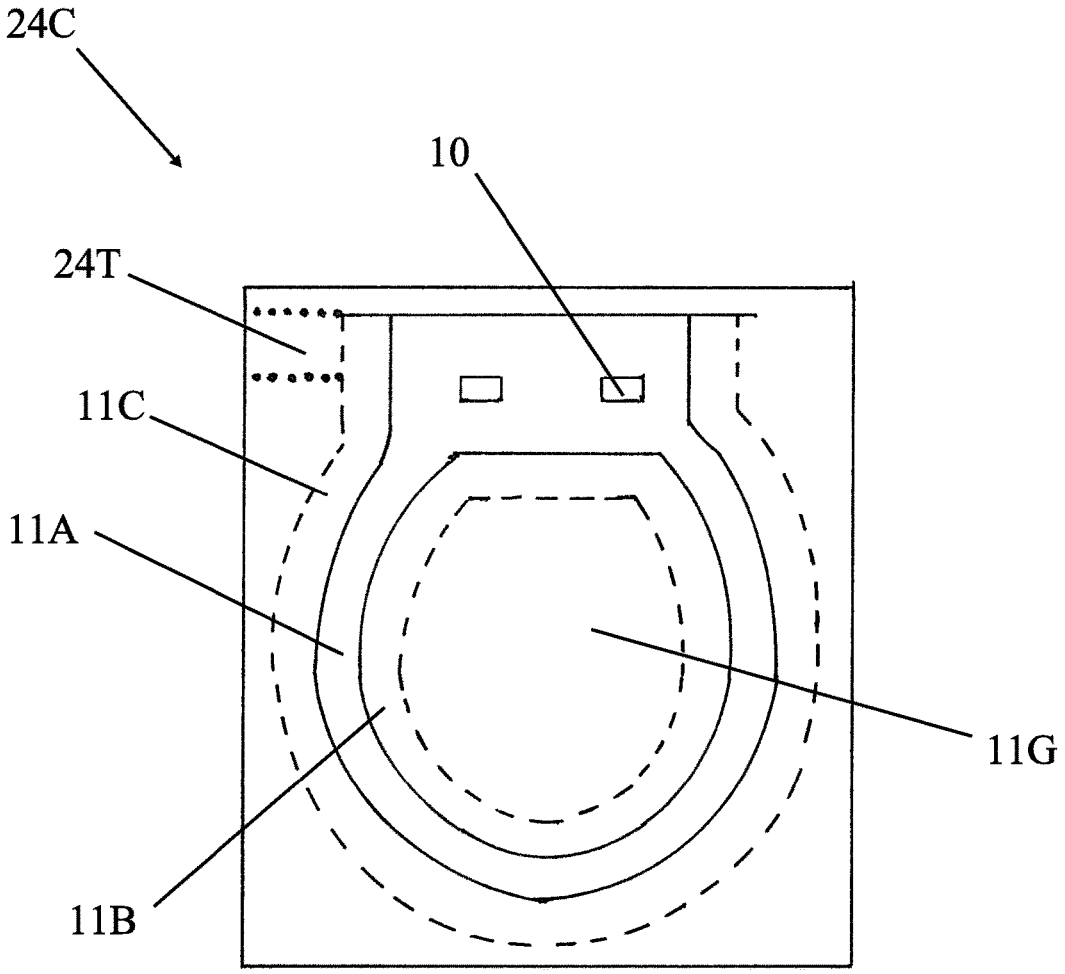
Figure 33:
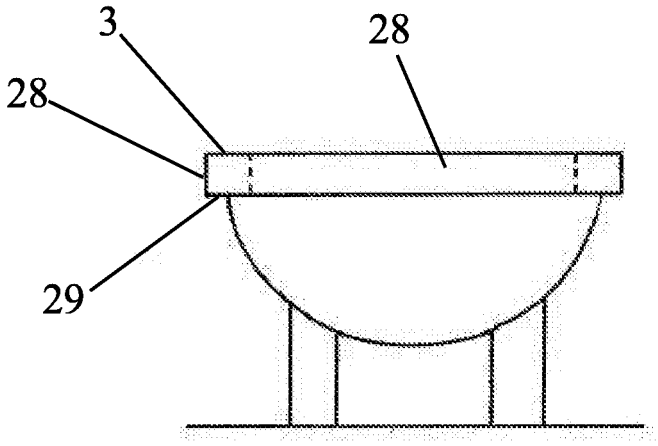
Figure 34:
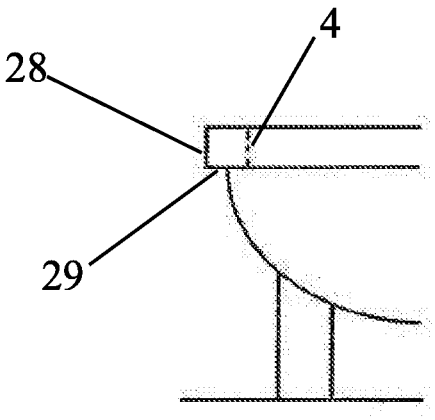
Figure 35A:
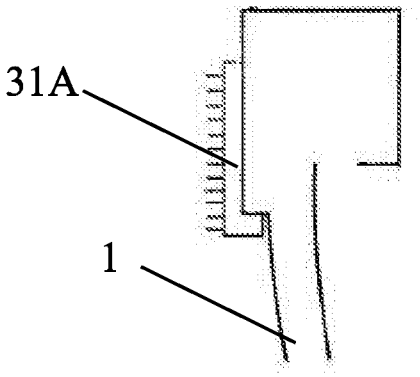
Figure 35B:
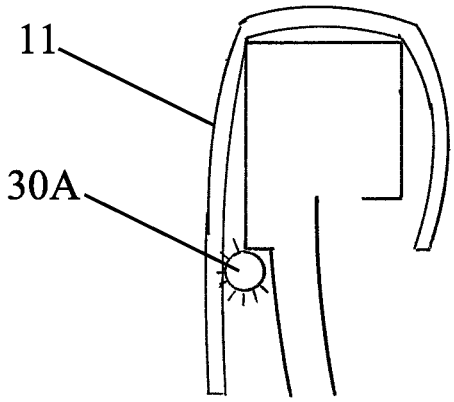
Figure 36A:
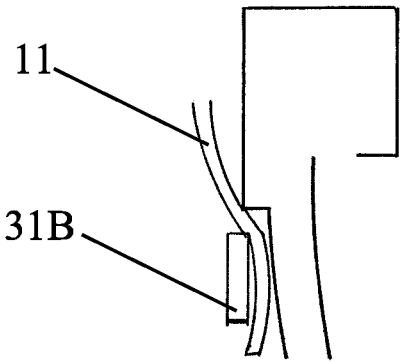
Figure 36B:
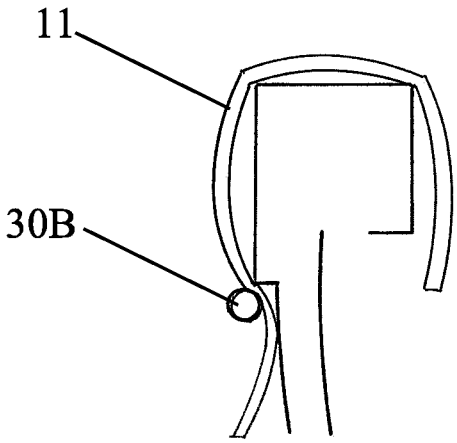
Figure 37:
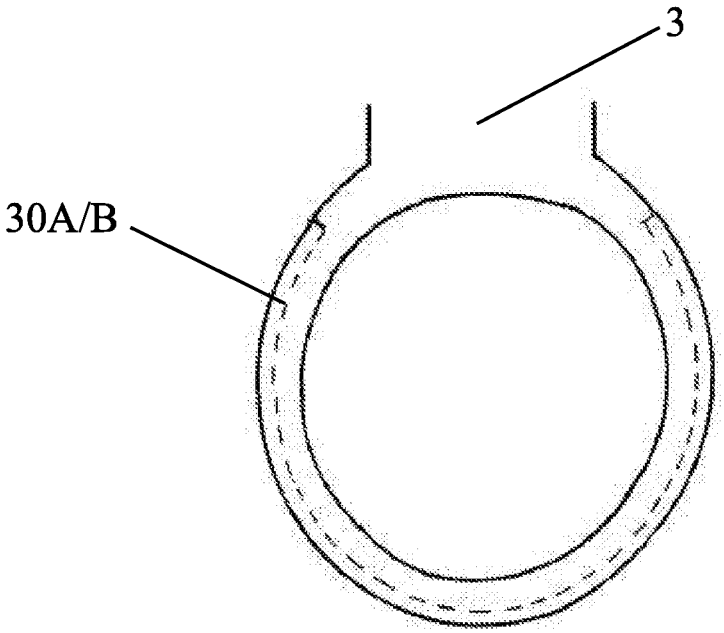
Figure 38:
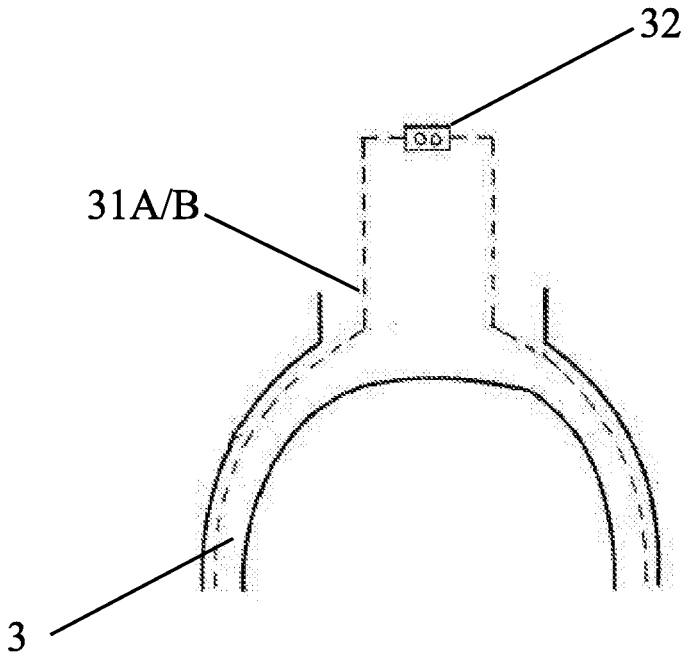
Figure 39:
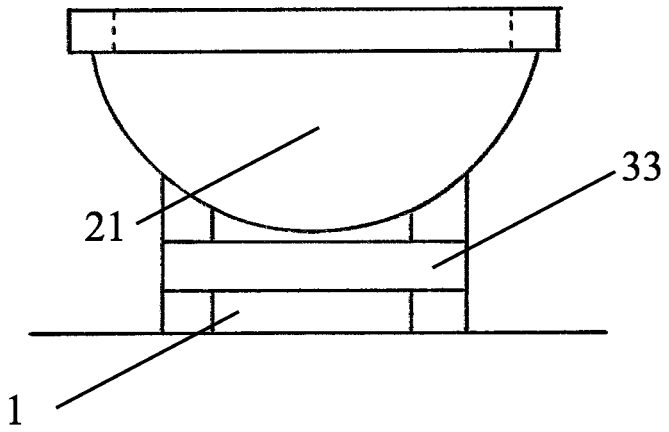
Figure 40:
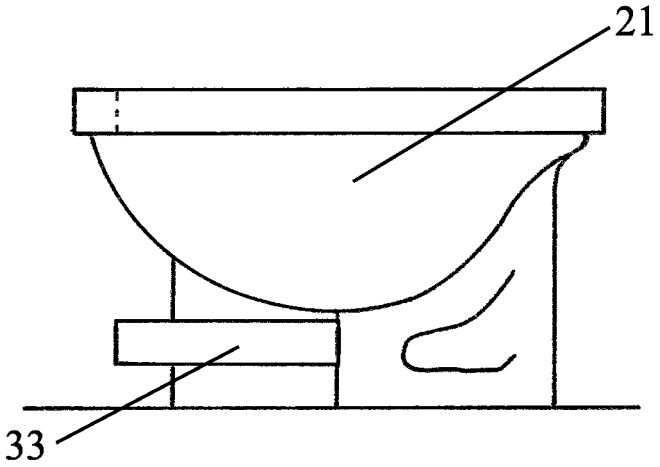
Figure 41A:
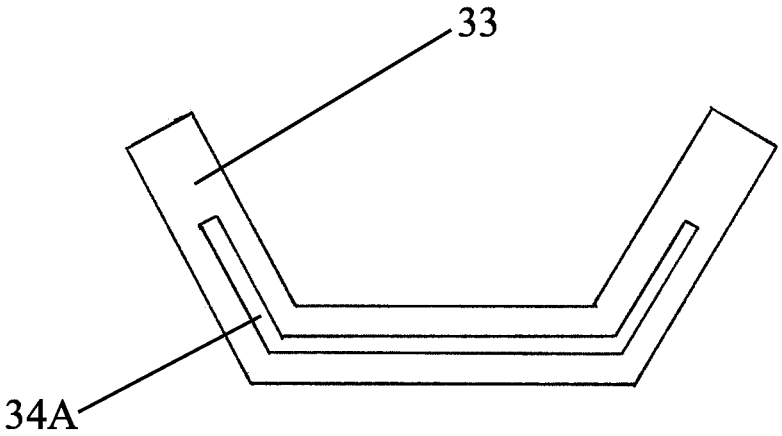
Figure 41B:
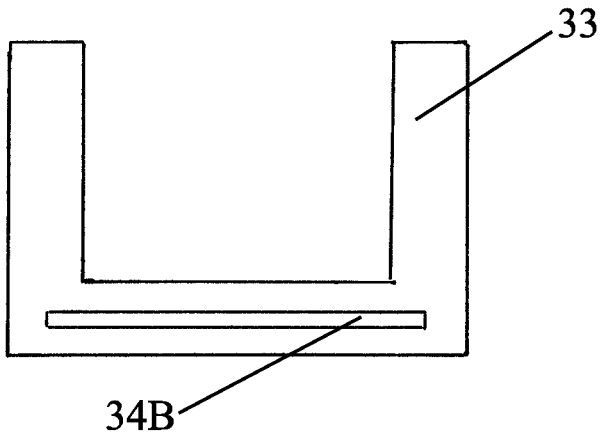
Figure 42A:
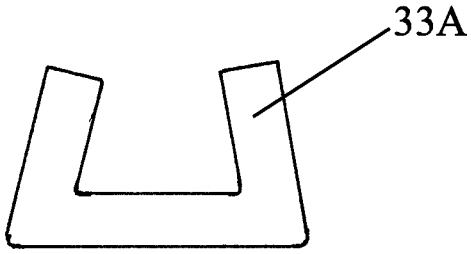
Figure 42B:
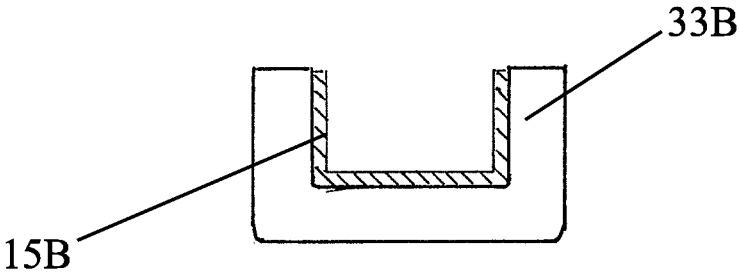
Figure 42C:
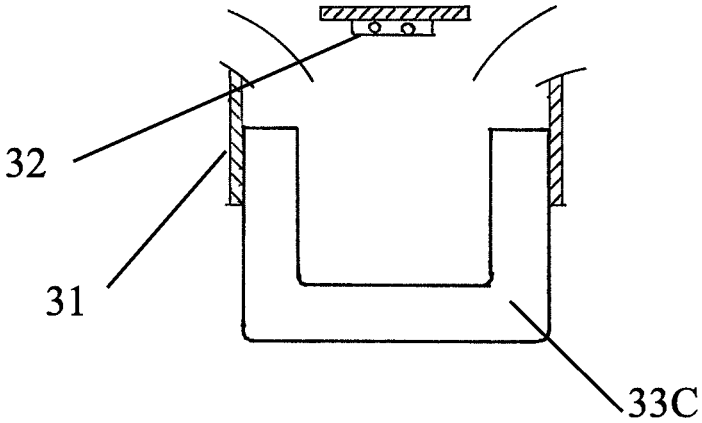
Figure 43:
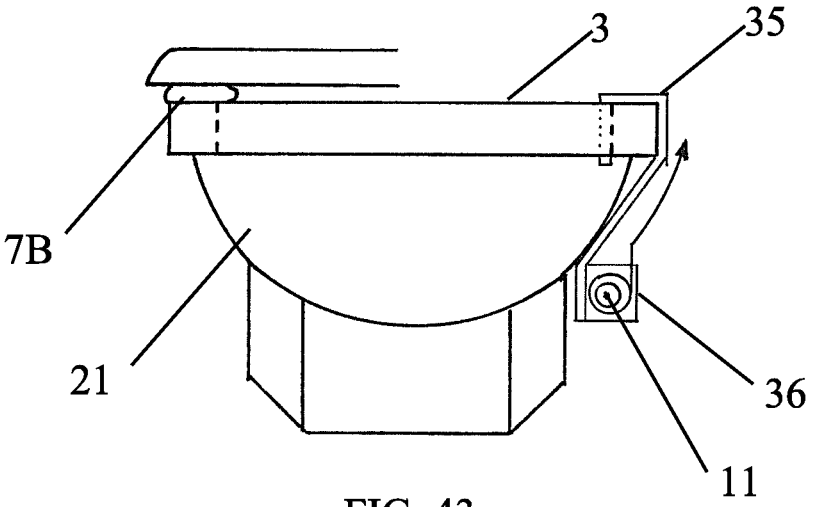
Figure 44:
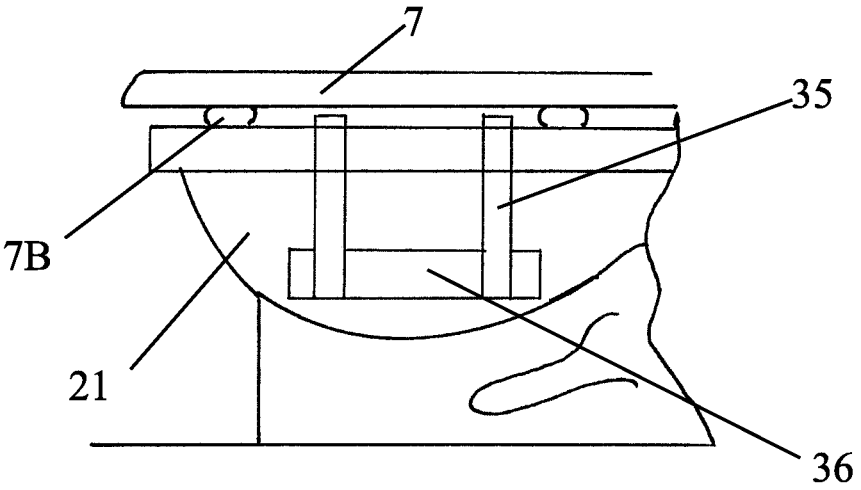
Figure 45:
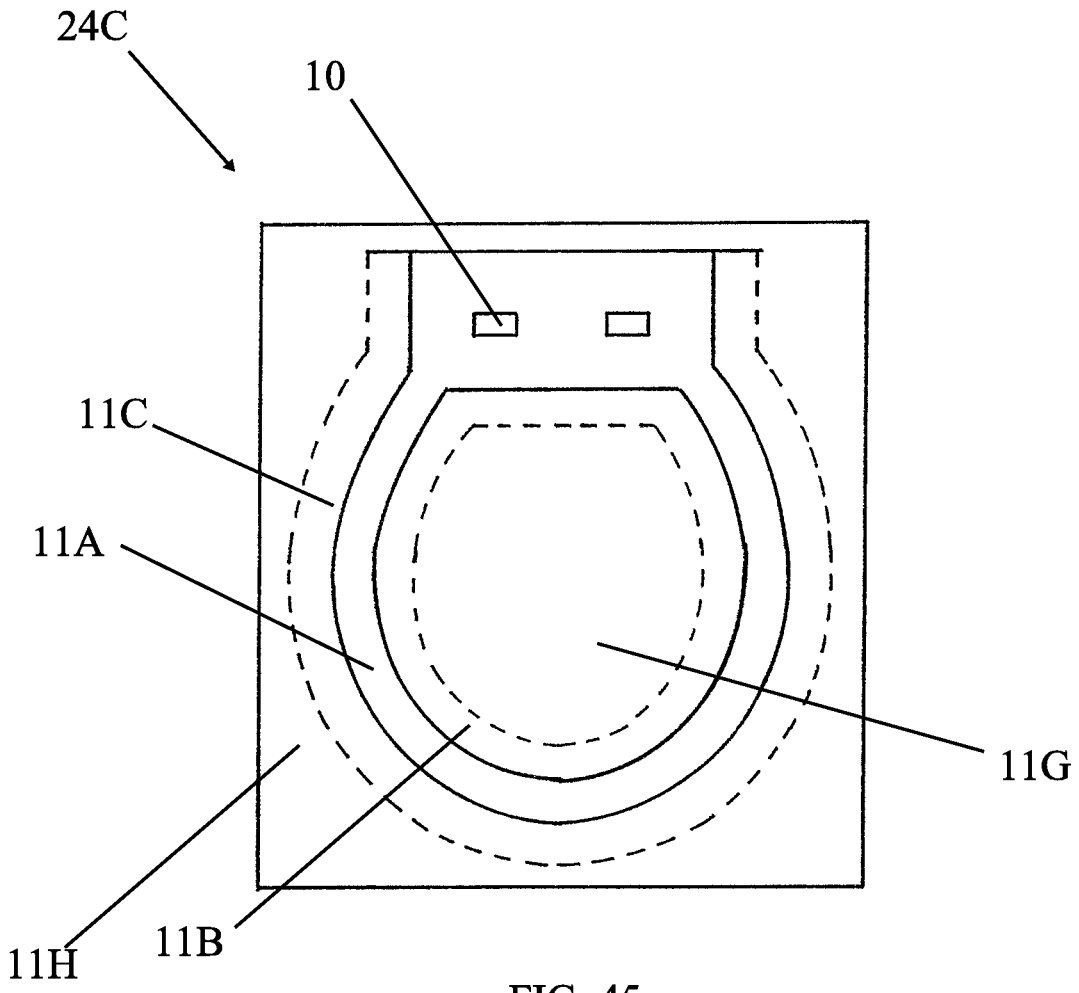
Figure 46:
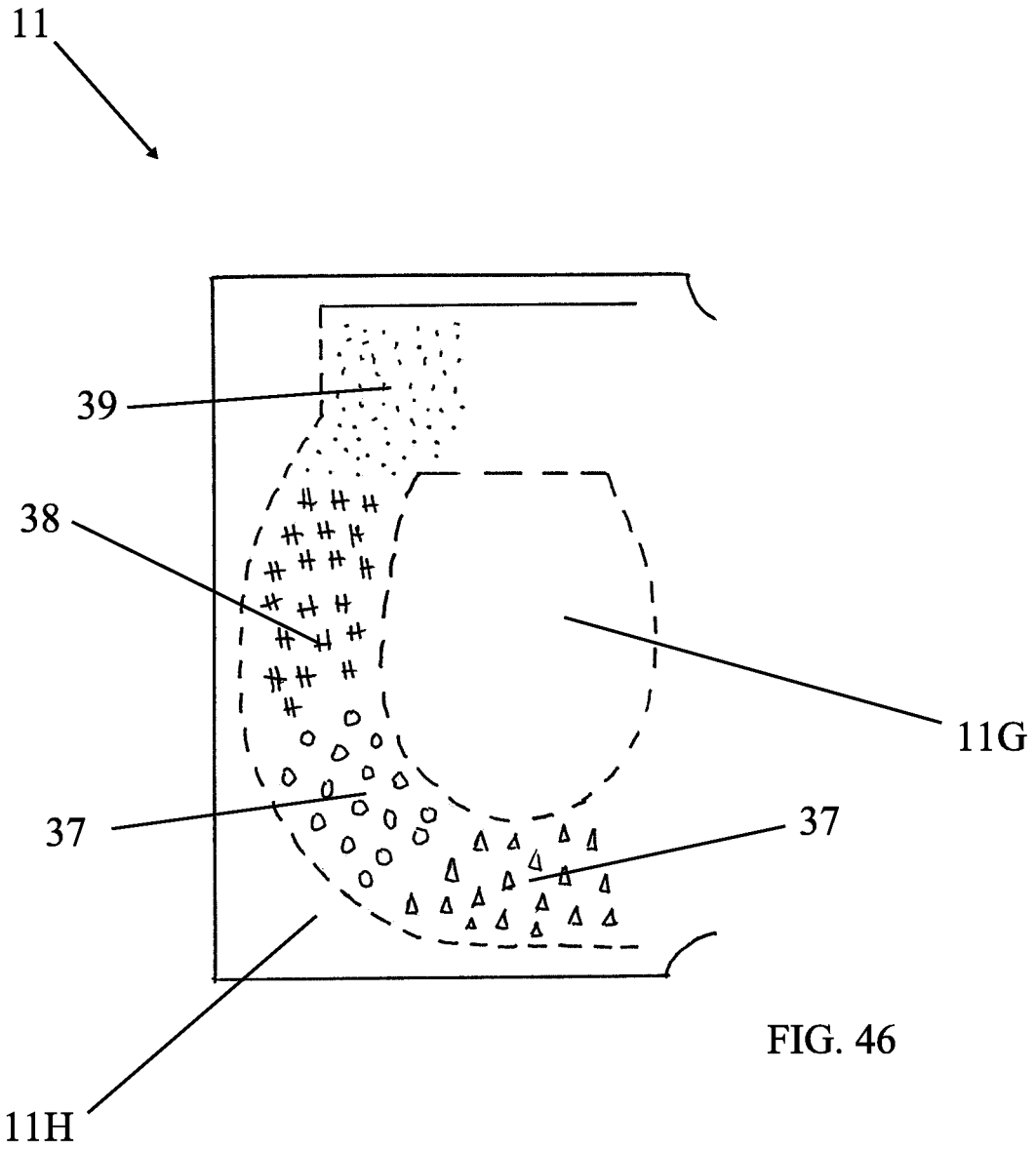
Figure 47:
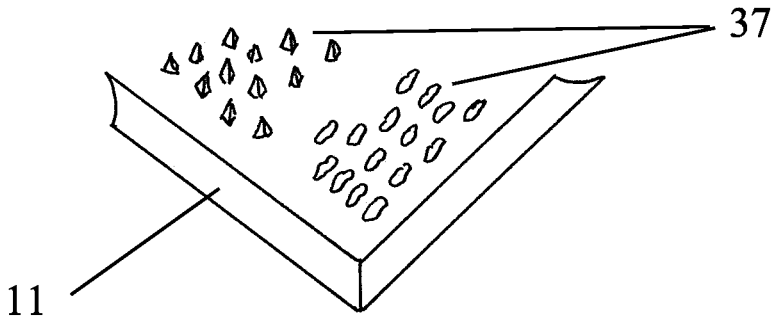
Figure 51:
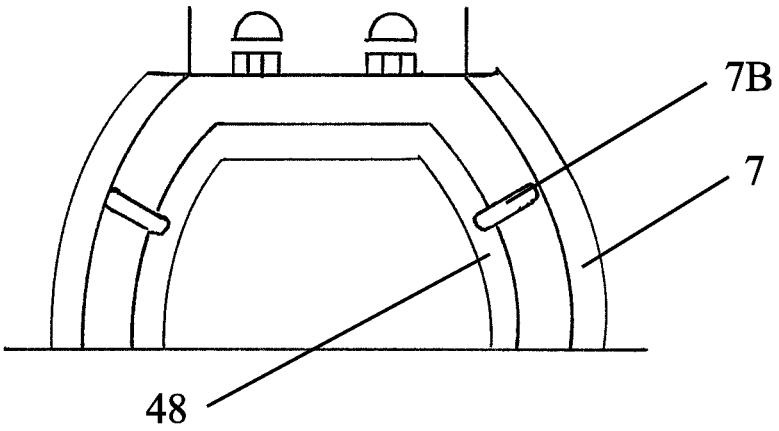
Figure 52:
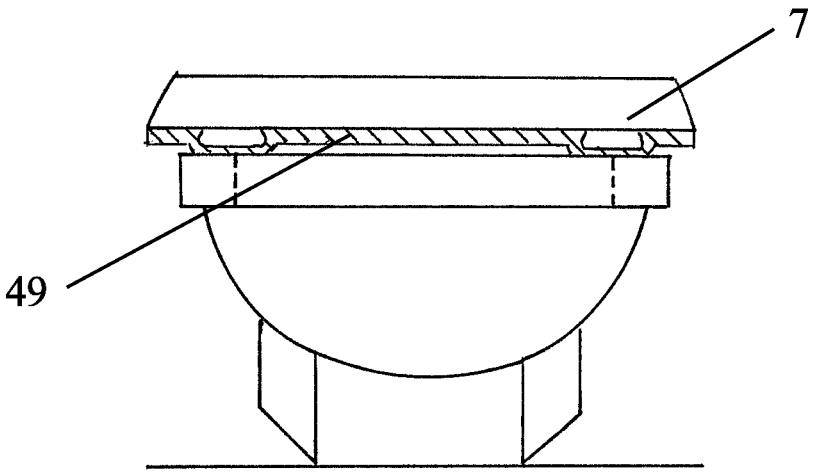
Figure 53A:
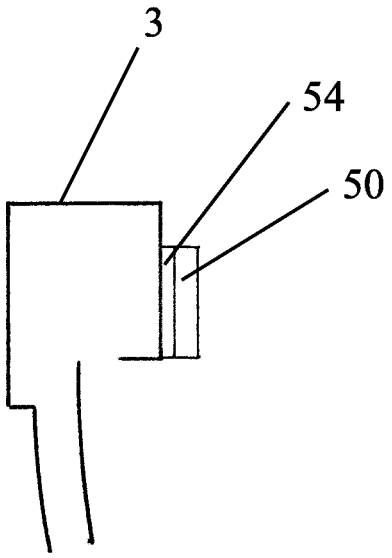
Figure 53B:
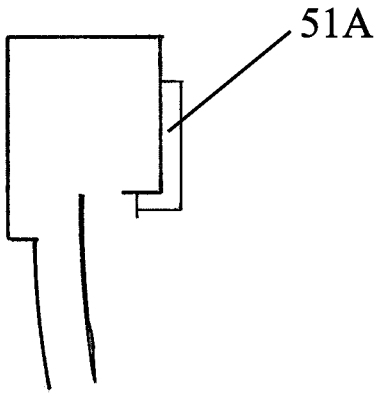
Figure 53C:
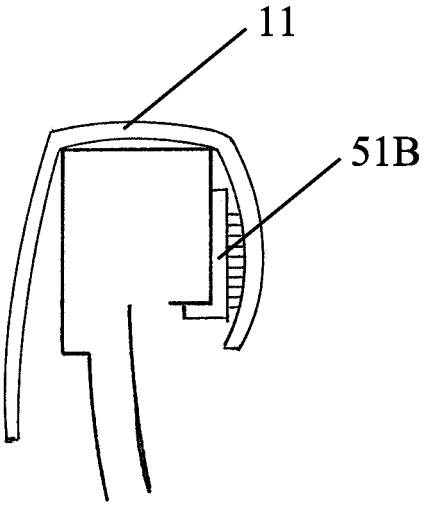
Figure 53D:
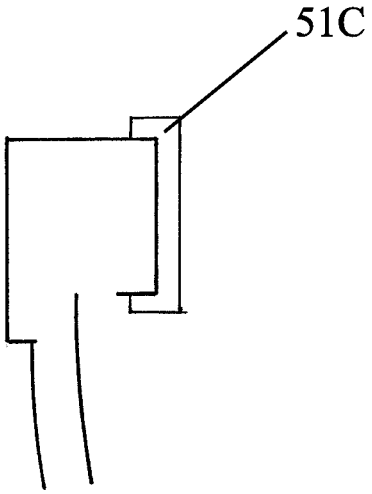
Figure 54A:
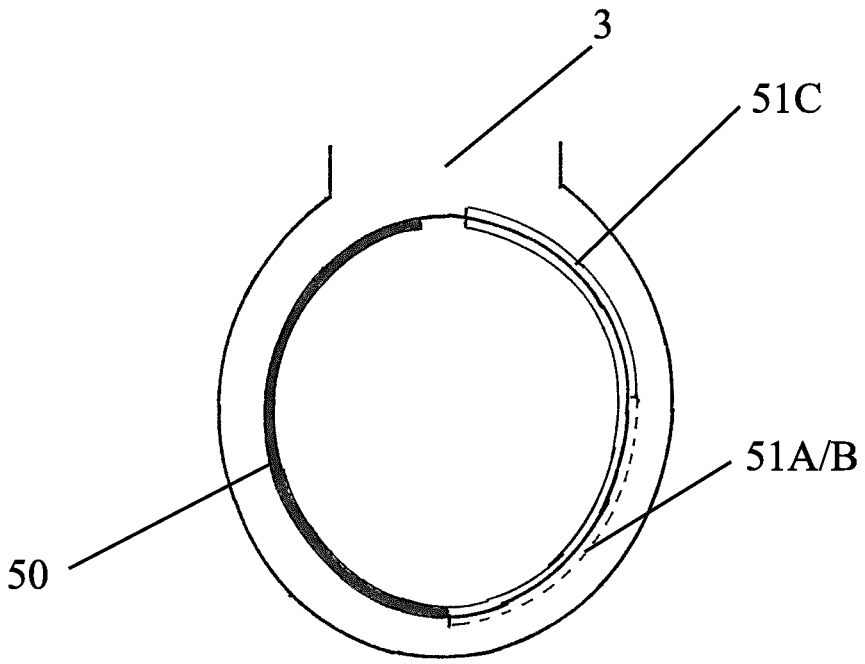
Figure 54B:
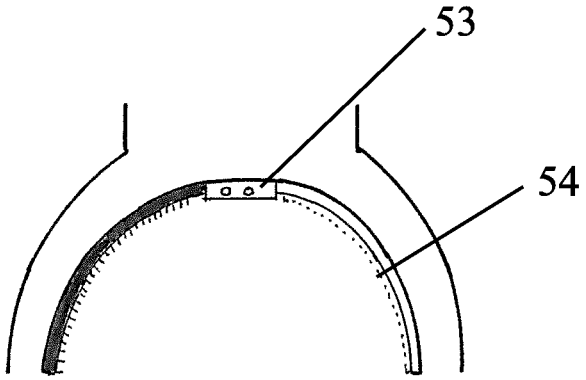
Figure 55:
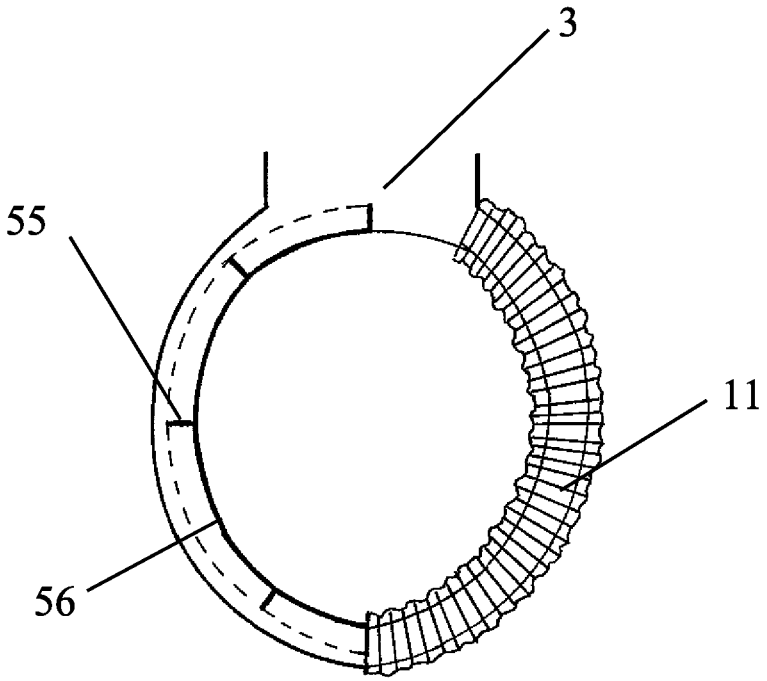
Figure 56:
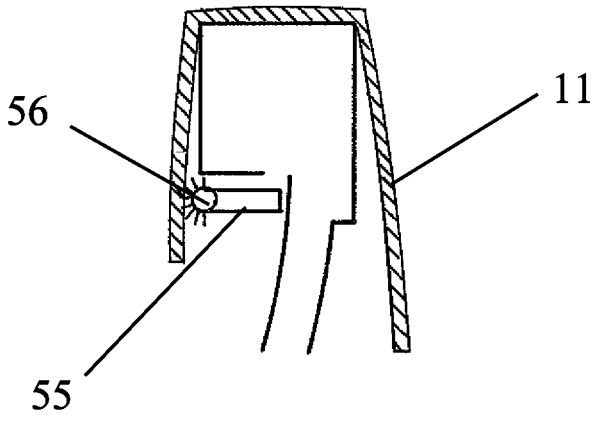
Figure 57:
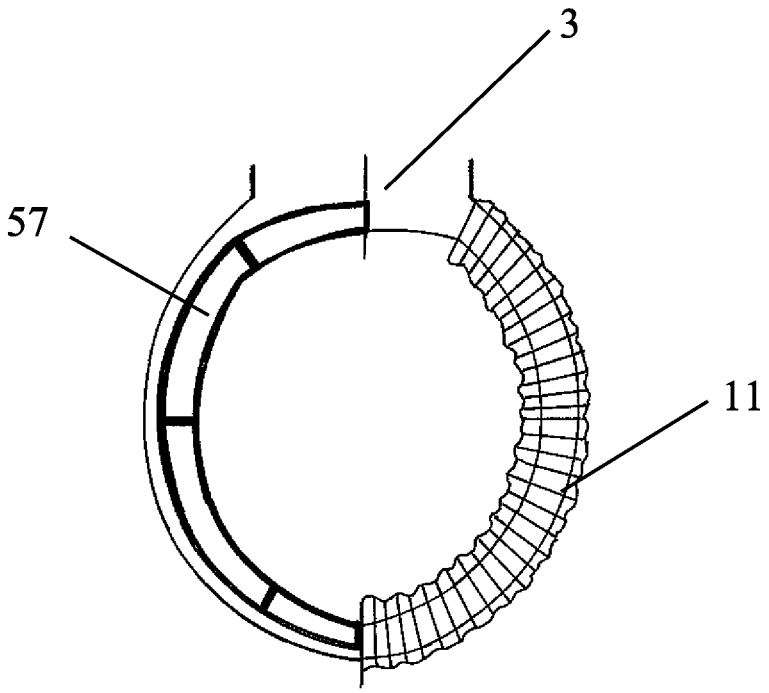
Figure 58:
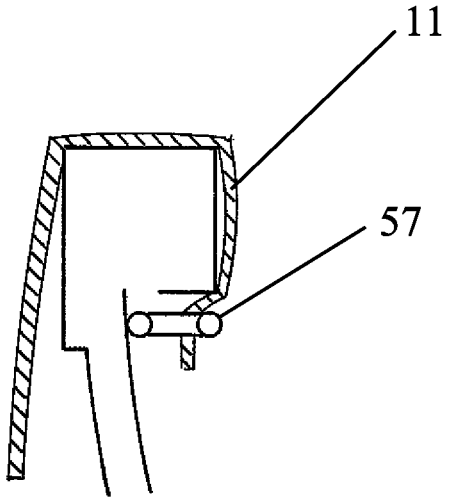
Figure 59A:
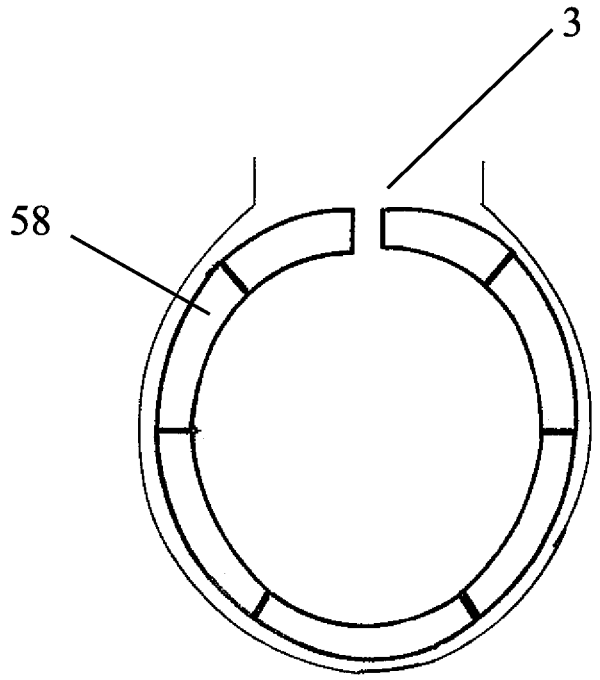
Figure 59B:
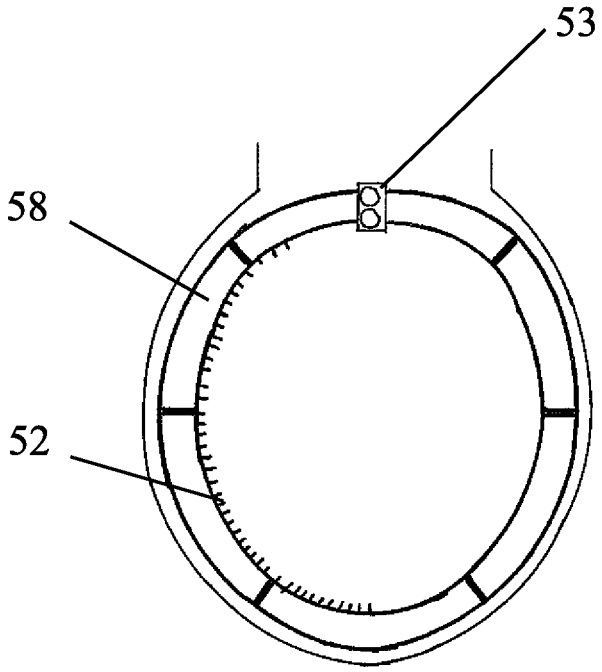
Figure 60:
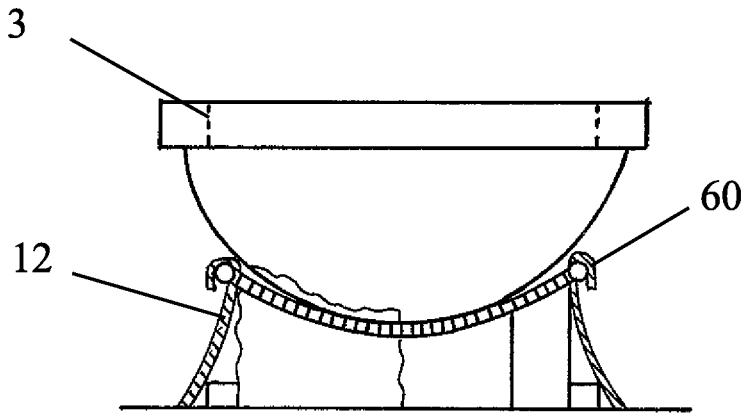
Figure 61:
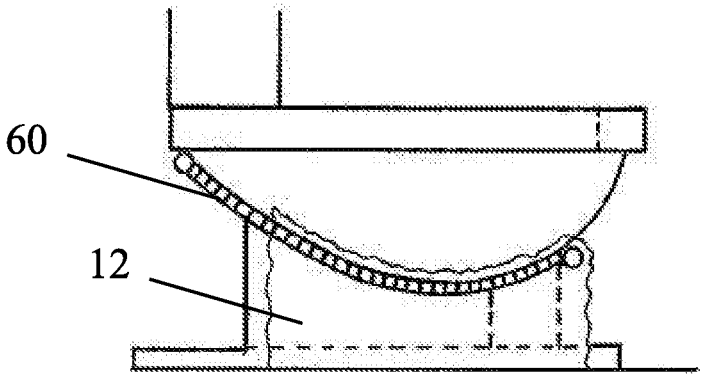
Figure 62:
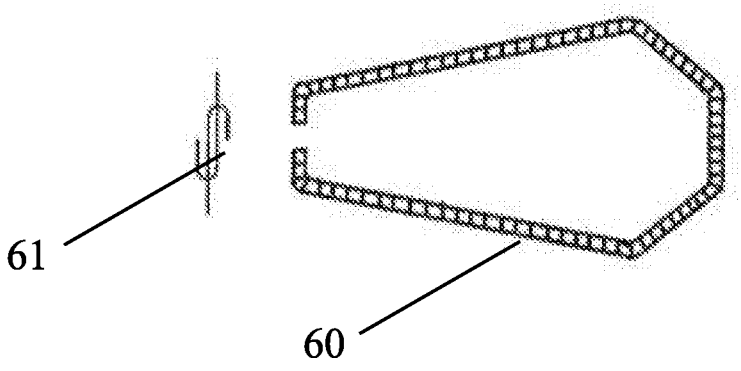
Figure 63:
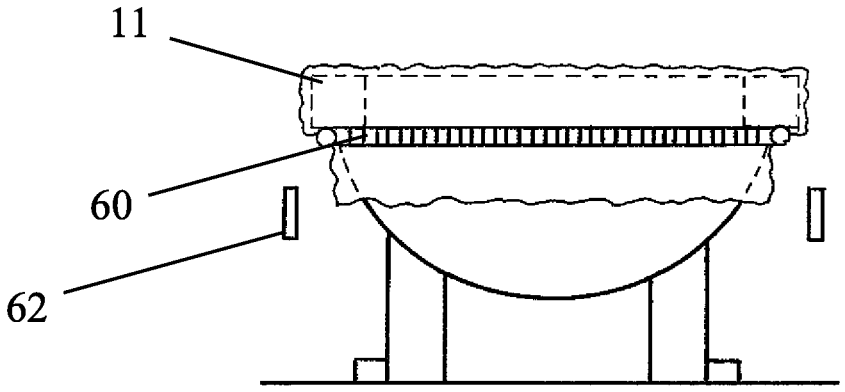
Figure 64:
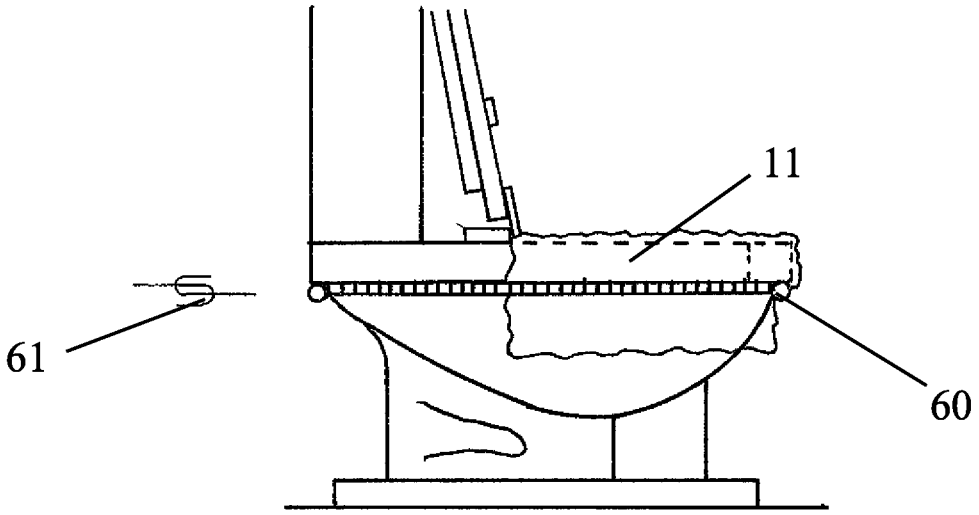
Figure 65A:
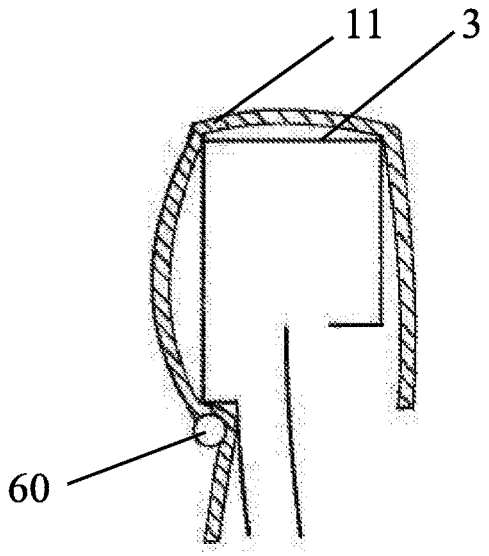
Figure 65B:
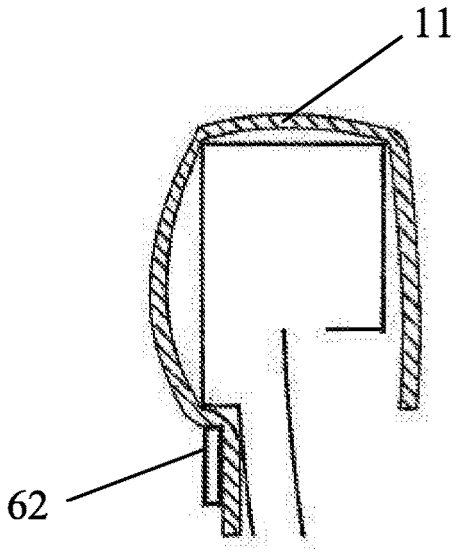
Figure 66:
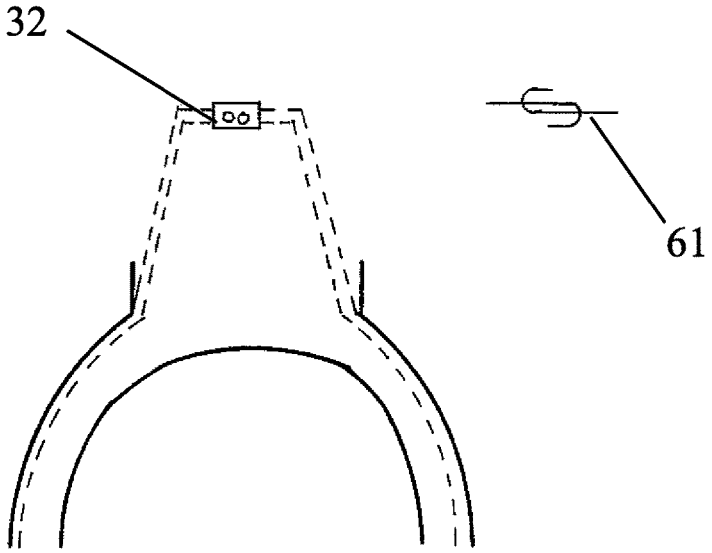
Figure 69:
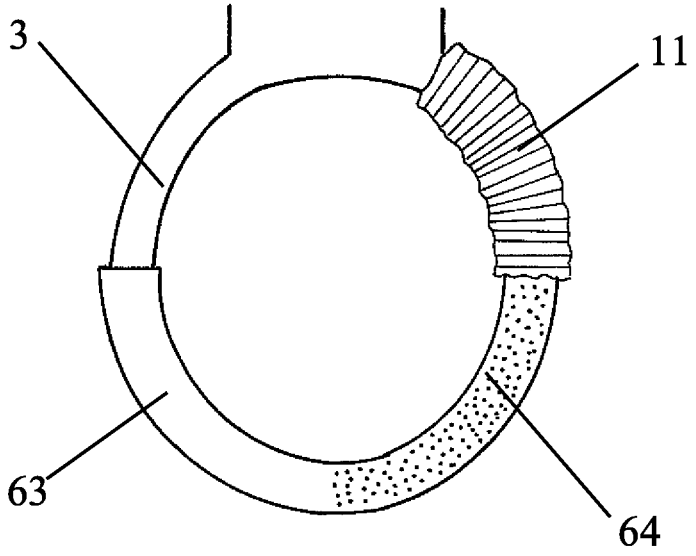
Figure 70:
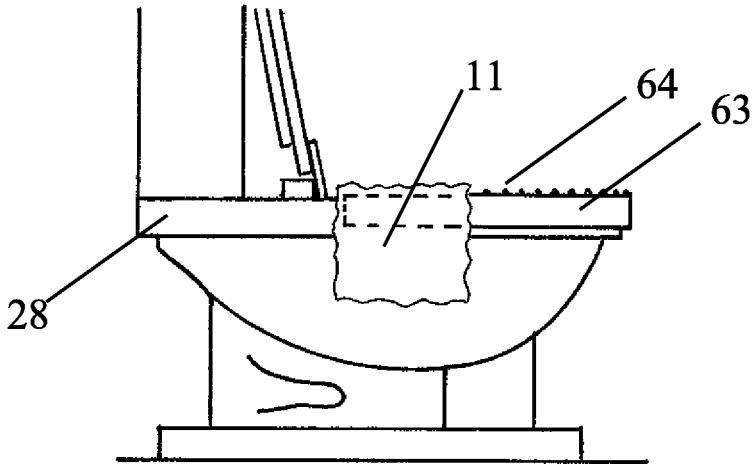
Figure 71:
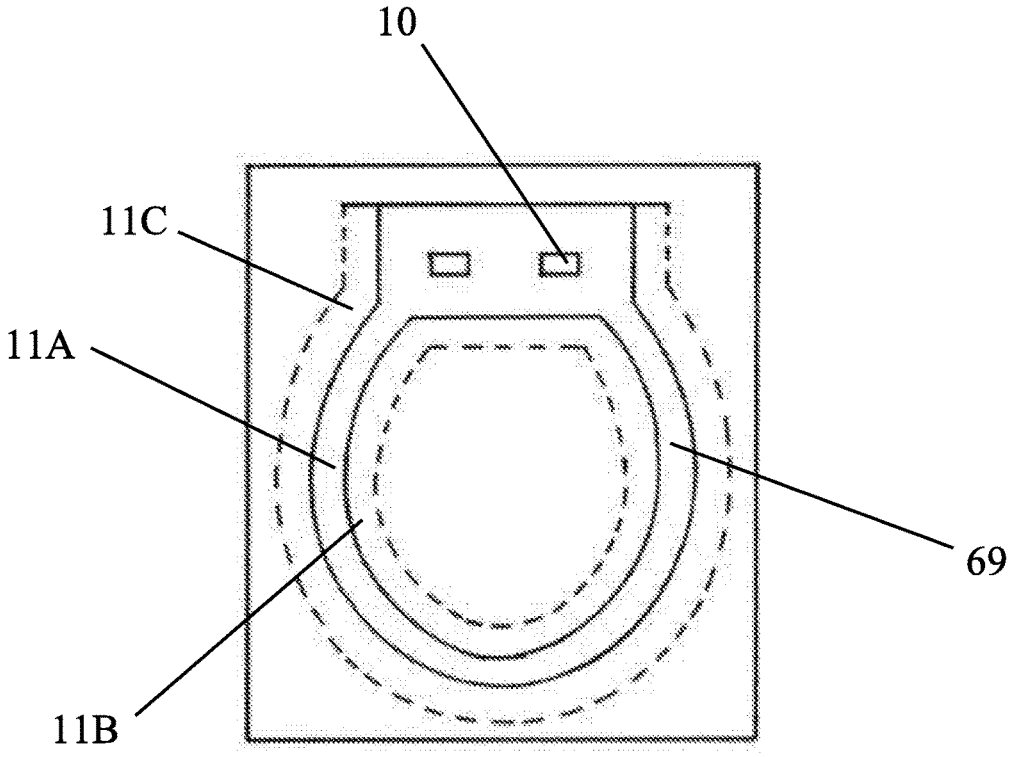
Figure 72:
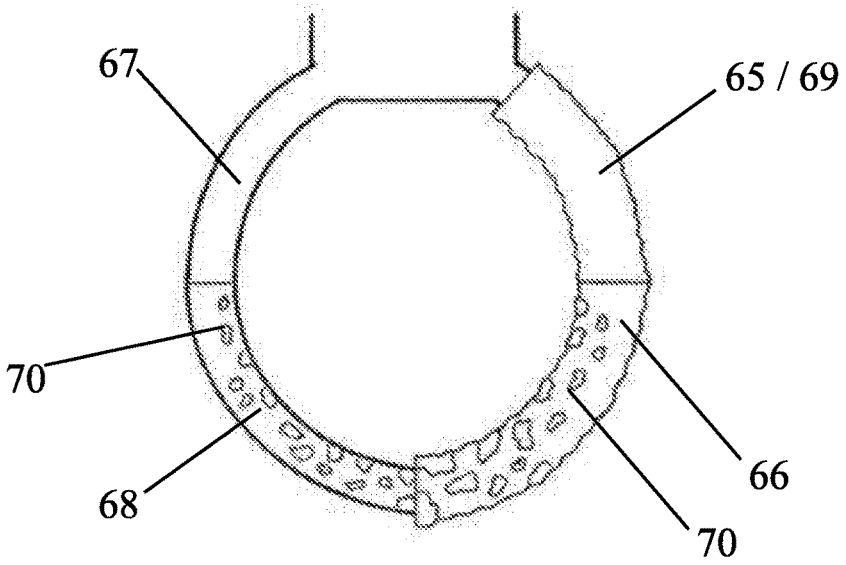

Having thus described the invention in general terms, reference will now be made to the accompanying drawings, which are not necessarily drawn to scale, and wherein:

FIG. 1 is a perspective view of a toilet according to various embodiments, prior to placement of any skirts or covers or accessories thereon;

FIG. 2 is a perspective view of the toilet of FIG. 1, illustrating thereon a rim accessory assembly according to various embodiments;

FIG. 3 is a perspective view of the toilet of FIG. 1, illustrating thereon a base skirt according to various embodiments;

FIG. 4 is a top view of the toilet of FIG. 1, illustrating there-around a floor mat according to various embodiments;

FIG. 5 is a cross-section of the rim cover/skirt of FIG. 2, illustrating one exemplary mounting method according to various embodiments;

FIG. 6 is a cross-section of the rim cover/skirt of FIG. 2, illustrating an exemplary light adhesive layer according to various embodiments;

FIG. 7 is a cross-section of the rim cover/skirt of FIG. 2, illustrating another exemplary mounting method according to various embodiments;

FIG. 8 is a top view of an exemplary spring tension rod, as also illustrated in FIG. 7 according to various embodiments;

FIG. 9 is a cross-section of the rim cover/skirt of FIG. 2, illustrating yet another exemplary mounting method according to various embodiments;

FIG. 10 is a top view of an exemplary barbed tension rod, as also illustrated in FIG. 9 according to various embodiments;

FIG. 11 is a cross section of a curtain rod or valence curtain-type opening through which the tension rod of FIGS. 7-8 (by way of non-limiting example) may pass according to various embodiments;

FIG. 12 is a cross-section view of a possible valence-type mounting method for the tension rod of any of FIGS. 7-10 according to various embodiments;

FIG. 13 is a front view of a toilet seat assembly (merely a subset of the toilet assembly 100 of FIG. 1), illustrating an exemplary tension rod for mounting adjacent an outer surface of the toilet seat assembly according to various embodiments;

FIG. 14 is a front view of a toilet seat assembly (merely a subset of the toilet assembly 100 of FIG. 1), illustrating an exemplary floor mat extension for positioning adjacent an outer surface of the toilet seat assembly according to various embodiments;

FIG. 15 is a front view of the toilet assembly of FIG. 1, illustrating therein an exemplary water level line according to various embodiments, as informative for later figures below;

FIG. 16 is a front view of the toilet assembly of FIG. 15, further illustrating an exemplary seat hinge and rear rim cover sheet according to various embodiments, with the toilet assembly in an open configuration;

FIG. 17 is a front cross-sectional view of the toilet assembly of FIG. 15, further illustrating the exemplary seat hinge and rear rim cover sheet according to various embodiments, with the toilet assembly in a closed configuration;

FIG. 18 illustrates an exemplary seat hinge and rear rim cover sheet in isolation, as provided according to various embodiments;

FIG. 19 illustrates various sub-components, including exemplary fold lines, of the exemplary seat hinge and rear rim cover sheet of FIG. 18, as provided according to various embodiments;

FIG. 20 illustrates an exemplary adhesive layer, as may be provided according to various embodiments in conjunction with the seat hinge and rear rim cover sheet of FIG. 18;

FIG. 21 illustrates a gathered elastic type rim cover according to various embodiments;

FIG. 22 illustrates the gathered elastic type rim cover of FIG. 21 on a toilet assembly according to various embodiments; also illustrated is applicability to a base skirt according to various embodiments;

FIG. 23 is a top view of a toilet seat area, illustrating, in part, another exemplary seat hinge and rear rim cover sheet assembly according to various embodiments;

FIG. 24 illustrates the exemplary seat hinge and rear rim cover sheet assembly of FIG. 23, depicting therein various components thereof, including exemplary fold and/or cut lines, as provided according to various embodiments;

FIG. 25 illustrates an additional exemplary seat hinge and rear rim cover sheet assembly according to various embodiments, for comparison relative to the assembly illustrated in FIG. 24;

FIG. 26 is a front view of the exemplary seat hinge and rear rim cover sheet assembly mounted to a toilet assembly and adjacent hinges thereof according to various embodiments;

FIG. 27 illustrates yet another exemplary seat hinge and rear rim cover sheet assembly according to various embodiments;

FIG. 28 is another view of the assembly of FIG. 27, illustrating exemplary cut and/or fold lines thereof according to various embodiments;

FIG. 29 is a side view of the toilet assembly of FIG. 1, illustrating thereon one of the exemplary seat hinge and rear rim cover sheet assemblies of FIGS. 23-28 according to various embodiments;

FIG. 30 is a partial view of an embodiment of the seat hinge and rear rim cover sheet assembly that accommodates cut-outs for the hinges of the toilet assembly according to various embodiments;

FIG. 31 is a partial view of another embodiment of the seat hinge and rear rim cover sheet assembly that accommodates cut-outs for the hinges of the toilet assembly according to various embodiments;

FIG. 32 is a top view of an exemplary one of the various embodiments of the seat hinge and rear rim cover sheet assembly, as provided in a production or manufacturing carrier sheet (e.g., perforated) according to various embodiments;

FIG. 33 is a front view of the toilet assembly of FIG. 1, illustrating certain outer and lower rim surfaces according to various embodiments, as pertinent to certain immediately following views;

FIG. 34 is a side view of the toilet assembly of FIG. 33 according to various embodiments;

FIGS. 35A-B and 36A-B illustrate exemplary rod and band components for placement around an outer rim of the toilet assembly of FIGS. 33-34 according to various embodiments;

FIG. 37 is a top view illustrating an exemplary rod as in FIGS. 35B and 36B according to various embodiments;

FIG. 38 is a top view illustrating an exemplary band as in FIGS. 35A and 36A according to various embodiments;

FIG. 39 is a front view of the toilet assembly of FIG. 1, illustrating an exemplary dispenser assembly according to various embodiments;

FIG. 40 is a side view of the toilet assembly of FIG. 1, illustrating an exemplary dispenser assembly according to various embodiments;

FIGS. 41A-B top views of various embodiments of the exemplary dispenser assembly of FIGS. 39-40, as provided according to various embodiments;

FIGS. 42A-C illustrate additional embodiments of the exemplary dispenser assembly of FIGS. 39-40, as provided according to various embodiments;

FIG. 43 is a front view of the toilet assembly of FIG. 1, illustrating yet another exemplary dispenser assembly according to various embodiments, further incorporating a hanger bracket;

FIG. 44 is a side view of the toilet assembly of FIG. 1, further illustrating the dispenser assembly and hanger bracket of FIG. 43;

FIG. 45 is, analogous to FIG. 32, a top view of an exemplary one of the various embodiments of the seat hinge and rear rim cover sheet assembly, as provided in a production or manufacturing carrier sheet (e.g., perforated) according to various embodiments;

FIG. 46 is an exemplary rim cover sheet assembly, illustrating various surface textures and/or coatings according to various embodiments;

FIG. 47 is another view of the assembly of FIG. 46, illustrating a thickness of the rim cover sheet and the various surface textures and/or coatings according to various embodiments;

FIGS. 48A-B and 49 are side cross-sections views of the assembly of FIG. 46 according to various embodiments;

FIGS. 50A-D are exemplary illustrations of the toilet assembly (in part) of FIG. 1, illustrating various paths of impingement for a urine stream according to various embodiments, as relevant for certain feature(s) illustrated in the figures immediately below;

FIG. 51 is a top view, showing overlap of an exemplary toilet seat relative to a rim of the assembly according to various embodiments;

FIG. 52 is a front view analogous to that of FIG. 51 in top view, illustrating an exemplary cover or sheet on a lower surface of the seat of FIG. 51, as provided according to various embodiments;

FIGS. 53A-D illustrate exemplary bars and/or bands for attachment and/or mounting inside the rim of FIG. 51, according to various embodiments;

FIGS. 54A-B are top views illustrating the various exemplary bars and/or bands of FIGS. 53A-D, according to various embodiments;

FIG. 55 is another top view illustrating an exemplary tension rod frame with stand-offs for mounting inside the rim of FIG. 51, according to various embodiments;

FIG. 56 is a cross-sectional view of the frame with stand-offs of FIG. 55 according to various embodiments;

FIG. 57 is another exemplary tension rod frame according to various embodiments;

FIG. 58 is a cross-sectional view of the frame of FIG. 57 according to various embodiments;

FIGS. 59A-B are top views of an exemplary wire loop frame according to various embodiments;

FIGS. 60-62 are front, side, and cross-sectional top views, respectively, of a bungie or elastic-type cord for use in conjunction with an exemplary base skirt according to various embodiments;

FIGS. 63-64 are front and side views, respectively of a bungie or elastic-type cord for use in conjunction with an exemplary rim cover according to various embodiments;

FIGS. 65A-B are cross-sectional side views of the exemplary elastic band and bungie cord of FIGS. 63-64 according to various embodiments;

FIG. 66 is a top view of exemplary clasp and hook arrangements for the bungie cord and elastic band components of FIGS. 63-64, as provided according to various embodiments;

FIGS. 67A-68C illustrate various rim frame assemblies according to various embodiments;

FIG. 69 is a top view, illustrating various rim frame assemblies according to various embodiments;

FIG. 70 is a side view of the various rim frame assemblies of FIG. 69, as provided according to various embodiments;

FIG. 71 is a top view of a cover sheet assembly having dye components incorporated therein according to various embodiments; and FIG. 72 illustrates various dye features, as provided according to various embodiments, in conjunction with the cover sheet of FIG. 71.

DETAILED DESCRIPTION OF VARIOUS EMBODIMENTS

Various embodiments of the present invention will now be described more fully hereinafter with reference to the accompanying drawings, in which some, but not all embodiments of the invention are shown. Indeed, embodiments of the invention may be embodied in many different forms and should not be construed as limited to the embodiments set forth herein. Rather, these embodiments are provided so that this disclosure will satisfy applicable legal requirements. Unless otherwise defined, all technical and scientific terms used herein have the same meaning as commonly known and understood by one of ordinary skill in the art to which the invention relates. The term "or" is used herein in both the alternative and conjunctive sense, unless otherwise indicated. Like numbers refer to like elements throughout.

Still further, to facilitate the understanding of this invention, a number of terms are defined below. Terms defined herein have meanings as commonly understood by a person of ordinary skill in the areas relevant to the present invention. Terms such as "a", "an" and "the" are not intended to refer to only a singular entity, but include the general class of which a specific example may be used for illustration. The terminology herein is used to describe specific embodiments of the invention, but their usage does not delimit the invention, except as outlined in the claims.

As mentioned previously herein, various embodiments of the present invention utilize an innovative, multi-faceted, and comprehensive approach to toilet bowl hygiene and sanitation, which is distinct from the previous approaches known and generally understood. The various embodiments provided herein, although capable of representing a consolidated or comprehensive assembly can also each be used independently or in conjunction with any sub-combination or all of the other features described and even in conjunction with (i.e., to supplement) the prior-known approaches to toilet hygiene and sanitation previously and/or currently utilized.

The materials, structures and configurations of the covers and skirts, including surface coatings, textures, impregnations, layers and adhesives, as well as the various attachment methods, devices, apparatus and dispensers improve the efficiency and efficacy of the hygiene and sanitation of the toilet cleaning process by minimizing handling and exposure to biological contamination via rapid and minimal contact removal and disposal of the urine contaminated covers; the rapid attachment of the new covers; the pre-covering of difficult to clean regions; and possibly by the increased frequency of the cleaning process.

Bearing this in mind, with reference to FIG. 1, there is illustrated an exemplary toilet assembly 100, to which various embodiments of the covers and skirts (and associated components) may be mounted and/or otherwise adhered. The exemplary toilet assembly 100 includes—in the illustrated embodiment—a base 1, base bolts 1B, a water tank 2, a bowl rim 3, an inner rim side 4, an outer rim side 28, an inner bowl 5, water flush channels 6 (see FIG. 5), a seat 7 (with a set of bottom rests or pads 7B and a seat bottom surface 47), a lid 8, a flush valve 9, and a pair of seat/lid hinges 10. According to the various embodiments provided herein, the illustrated toilet assembly 100 of FIG. 1 may be configured generally as commonly known and well-understood in the industry, but for the various attachments described further below. In this sense, it should be understood that any of the above-listed components of the exemplary toilet assembly 100 are simply that—exemplary—and thus non-limiting, such that in certain embodiments the toilet assembly may be otherwise structured (i.e., with differently shaped or sized tanks 2, or bases 1, or the like), as is commonplace in the general toilet industry. Notably, though, the exemplary toilet assembly 100 and others analogous thereto generally include certain "hard to clean" areas, including for example the base bolts 1B, the hinges 10, an underside (i.e., seat bottom surface 47) of the seat 7, including around the pads 7B, and the like.

Turning now to FIG. 2, illustrated therein is an exemplary toilet bowl rim cover 11, which may be in certain embodiments draped over or otherwise adhered, mounted, or attached to the rim 3 of a toilet bowl assembly 100 as in FIG. 1. As may be understood from FIG. 2, the material of the rim cover 11 is generally flexible (i.e., defining a flexible rim cover), so as to permit the draping thereof over the rim 3. Additional details in this respect will be described elsewhere herein, including—by way of non-limiting examples, the way in which the rim cover 11 may be defined by a plurality of perforated and/or scored fold lines, so as to facilitate draping as illustrated in FIG. 2.

According to various embodiments, it should be understood that the rim cover 11 of FIG. 2 may be made from a variety of materials, fabric-based or otherwise. In certain embodiments, the rim cover 11 may be made from a biodegradable material. Still further, as will become evident from discussion elsewhere herein, the rim cover 11 may be coated or impregnated with anti-bacterial, anti-virus, anti-germ, or the like agents to improve sanitation and reduce the spread of illness and/or disease. In at least one embodiment, the rim cover 11 may be a "flushable" biodegradable material that may be designed as a "single-use" product, obtainable via a dispenser assembly or the like, as also detailed elsewhere herein. In other embodiments, the rim cover 11, whether biodegradable or of another material, may be designed to be a multi-use product.

In still other various embodiments, the rim cover 11 may be formed from a flexible sheet of absorbent material, which may be natural or synthetic, plain or coated, or impregnated, as mentioned elsewhere herein. So configured, the rim cover 11 is able to collect and absorb a certain volume of urine (i.e., spray from a urine stream or the like), thereby keeping surfaces of the toilet bowl assembly 100 (e.g., the rim 3, the inner rim side 4, and/or the outer rim side 28 free of urine stain, bacterial, viruses, germs, and the like.

As visible in FIG. 2, the rim cover 11 may extend substantially all the way around a circumference of the rim 3 of the toilet bowl assembly 100 of FIG. 1. In certain embodiments, though, the rim cover 11 may extend only partially around the rim 3, whether intermittently or periodically, as may be desirable so as to protect only certain "high risk" areas, prone to urine stain and/or contamination. As will be described in further detail elsewhere herein, the rim cover 11 may be selective attachable or securable to at least the rim 3; still further, in certain embodiments, the rim cover 11 may contain additional features during the production thereof, which features may be perforated relative to the features illustrated in FIG. 2, for example for removal thereof for draping into the interior of the toilet bowl (i.e., the inner bowl 5).

FIG. 3 illustrates an exemplary toilet base skirt 12, which may be configured by analogy, much the same—in terms of material and shape and protective characteristics—as the rim cover 11. Instead of being draped over the rim 3 of the toilet bowl assembly, though, the base skirt 12 is configured according to various embodiments to substantially surround the base 1 of the assembly. In certain embodiments, the skirt 12 may extend around an entirety of a circumference of the base 1. In other embodiments, the skirt 12 may extend around a majority of the circumference, for example, such that a minimal gap may be left (e.g., for clasps or the like, as detailed elsewhere herein) behind the base 1 of the assembly (i.e., where not visible in FIG. 3).

Like the rim cover 11, the skirt 12 may be configured for temporary use, from a single disposable use to multiple hours or several days, depending upon the amount of urine collected and/or the wishes of the user in terms of changing frequency, volume of use, or the like. As with the rim cover 11, the skirt 12 according to various embodiments may be made of a biodegradable and/or flexible material (i.e., defining a flexible skirt), so that it may conform, at least in part to a shape of the base 1 to which it is attached and/or positioned adjacent to when in use. In certain embodiments, the skirt 12 may be selectively attached to or secured relative to the base 1, as will be detailed further elsewhere herein.

According to various embodiments, the material of the cover 11 and skirt 12 discussed above may be flexible and one of paper, fiber, textile, synthetic, material, or the like, with the primary requirement being the presence of one or more absorptive characteristics, whether inherent to the material itself and/or via the provision of one or more barrier layer(s), adhesive layer(s), wetting/surfactant coatings, anti-bacterial/hygiene/sanitation coatings, odor-reducing and/or scenting coatings, surface decorative or color patterns, or the like, all as will be further detailed elsewhere herein.

Figure 50A:
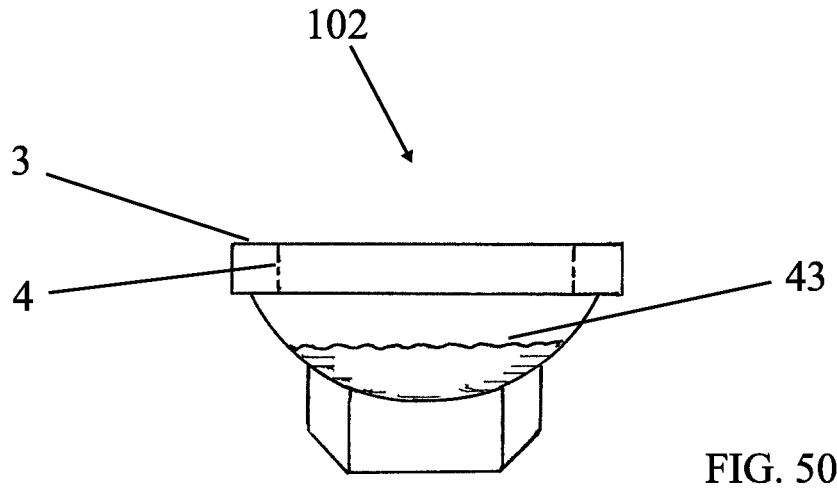
Figure 50B:
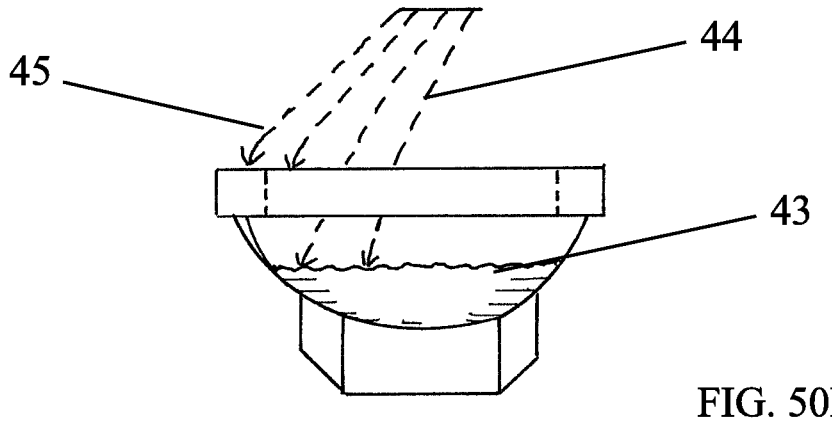
Figure 50C:
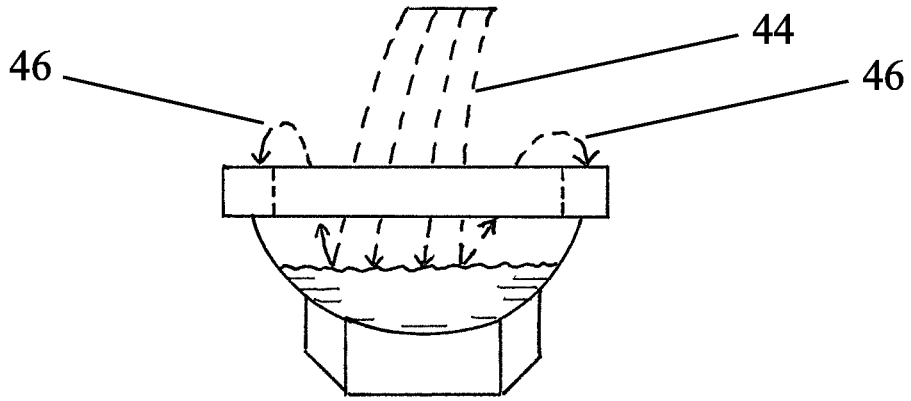
Figure 50D:
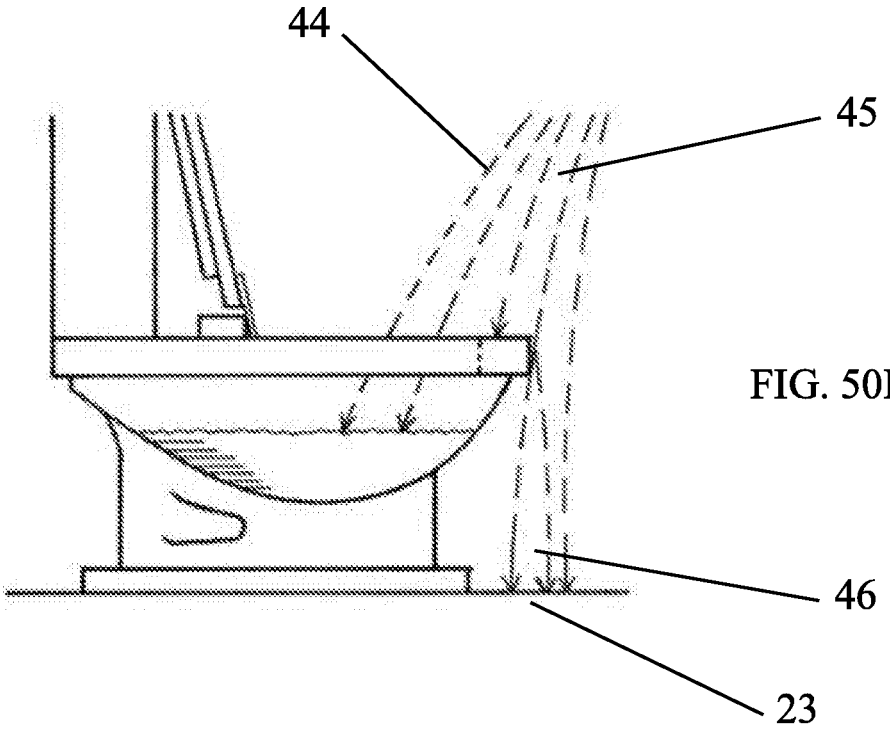
Figure 50E:
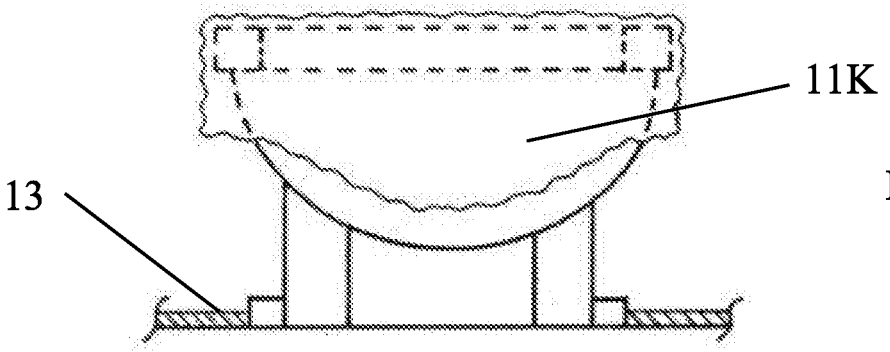

Before continuing with details surrounding the structural and material characteristics of the cover 11 and skirt 12, reference is made now to FIG. 4, wherein there is illustrated a top view of the toilet bowl assembly 100 of FIG. 1, further provided with an exemplary floor mat 13 for placement around the base 1 of the toilet assembly (see also FIG. 1, for perspective view, by way of comparison; see also FIG. 50E, as described elsewhere herein, illustrating as well an exemplary mat 13). In contrast with the cover 11 and skirt 12, according to various embodiments, while the mat 13 may likewise be configured to absorb and/or entrap urine and/or other materials, the mat 13 itself may be made from a relatively conventional type of material. The mat 13 may be provided, in certain embodiments, with an anti-slip layer on the surface of the mat facing the floor. In certain embodiments, though, a portion of the mat 13 that is positioned substantially adjacent the base 1 of the assembly 100 may be configured (e.g., with attachments of some sort, as detailed elsewhere herein) for selective attachment to the base skirt 12, such that at least a portion of the base skirt 12 overlays the mat 13 and provides a "zero-gap" area of protection around the base 1 of the toilet bowl assembly.

With reference now to FIGS. 5-6, additional details of the rim cover 11 may be understood. Specifically, the draping generally of the rim cover 11 over the rim 3 of the toilet bowl assembly 100 may be seen according to various embodiments. A portion of the rim cover 11 is positioned adjacent the inner rim 4, while another is positioned adjacent the rim 3 itself. According to various embodiments, the rim cover 11 is sized and shaped so that an additional portion is also positioned adjacent the outer rim 28 of the toilet assembly. In certain embodiments, as understood from FIG. 5, the portion of the rim cover 11 adjacent the outer rim 28 need not be in direct contact with the outer rim 28; instead a space may be provided therein. Of course, in other embodiments, the portion of the rim cover 11 adjacent the outer rim 28 may be in some manner held in contact with the outer rim 28, for example, via utilization of a first mounting assembly (i.e. an attachment rod or the like), as described elsewhere herein.

Remaining with FIG. 5, illustrated therein also are water flush channels 6 of the exemplary toilet bowl assembly 100 of FIG. 1. As well-known and understood in the industry, these water flush channels 6 are configured to introduce water into the inside of the toilet bowl 5 (see FIG. 1 again). Notably, as illustrated in FIG. 5, the draping of the rim cover 11 over the rim 3 of the toilet bowl assembly is accomplished in a manner such that the portion of the rim cover that is adjacent to (i.e., in certain embodiments in contact with) the inner rim 4 does not block or impede flow of water through the water flush channels 6 and into the inside 5 of the toilet bowl. In certain embodiments, the rim cover 11 may be supported so as to ensure a gap remains relative to the water flush channels 6, as will be detailed elsewhere herein (see e.g., FIGS. 55-57).

From FIG. 6, it may be understood that according to various embodiments the rim cover 11 may be provided with a light adhesive layer 15 on one surface (i.e., a bottom or interior surface) thereof. In certain embodiments, the light adhesive layer may be slightly sticky, so as to impede slippage of the rim cover 11 relative to one or more surfaces of the toilet bowl assembly, for example the rim 3 and/or the inner rim 4. According to various embodiments the adhesive layer may be constructed from a variety of different materials, as are well-known and understood to provide adhesive-type characteristics. In at least one embodiment, as illustrated, the light adhesive layer 15 may be provided upon an entirety of at least one surface of the rim cover 11. In other embodiments, the light adhesive layer may be provided only upon one or more portions of the rim cover 11 surface, so as to prevent other portions thereof (e.g., the portion adjacent the outer rim 28) from sticking to the toilet bowl assembly. In this manner, contact that could impede the flow of water through the water flush channels 6 may be avoided.

Pre-score and/or bending lines 14 are also illustrated in FIG. 6, as may be provided according to various embodiments. In certain embodiments, the pre-score and/or bending lines 14 are designed to ensure that the rim cover 11 drapes over the rim 3 (see FIG. 5) at an appropriate location of the rim cover 11, so that a pre-determined length of the rim cover 11 is permitted to drape downward adjacent the inner rim 4. Having pre-score and/or bending lines 14 in this manner facilitates proper placement and avoids user-introduced error in placement of the rim cover 11 relative to the rim 3. In certain embodiments, the lines 14 may be pre-scored, as such term is commonly known and used in the industry; in other embodiments, the lines 14 may be simply pre-bent fold lines or the like, so as to bias the rim cover 11 into a certain pre-formed orientation that substantially conforms to a "U-shape," as illustrated in FIG. 6.

Draping of the rim cover 11 over the rim 3, the inner rim side 4, and the outer rim side 28 is also illustrated in FIG. 7. In at least this embodiment, further provided is a first mounting assembly (i.e., a rod 16, wire loop 18, or the like, as referred to specifically elsewhere herein) configured to retain and selectively secure a portion of the rim cover 11 under a bottom lip of the inner rim side 4. The rod 16 may be in at least one embodiment a spring tension rod, such that upon placement of the rod within the inside 5 of the toilet bowl, it is biased to expand and exert pressure upon the inner rim side 4 and associated surfaces. In this manner, the rod 16 presses a portion of the rim cover 11 into direct contact with at least the bottom lip, thereby retaining it securely in an optimal positioning relative to the rim 3, the inner rim side 4, and the outer rim side 28. As illustrated in FIG. 7, by way of comparison with FIG. 6, it may be understood that in certain embodiments a majority of the rim cover 11 may not lie in direct contact with any of the rim 3, the inner rim side 4, and/or the outer rim side 28, but for portions thereof adjacent corners or intersections between the respective portions. In these embodiments, the rim cover 11 may not be provided with any adhesive layer 15; in other embodiments, though, at least a portion of the rim cover 11 may nevertheless contain an adhesive layer 15, which may or may not (as desired by a user) be activated.

In one embodiment, an adhesive layer 15 may be provided at least on the portion of the rim cover 11 adjacent to and in contact with the inside 5 of the toilet bowl adjacent the water flush channels 6 and the rod 16. Remaining with FIG. 7, it may also be understood that in those embodiments utilizing and/or otherwise incorporating a rod 16, pre-score and/or bend lines 14 (see FIG. 6) may also be provided in the rim cover 11. In other embodiments, pre-score and/or bend lines 14 may not be provided. It should thus generally be understood throughout this description that where different features are illustrated in and described in respective figures, any combination and/or sub-combination thereof may be incorporated into a particular embodiment, as may be desirable by a user or otherwise. Stated otherwise, no features are mutually exclusive relative to one another, except where explicitly indicated as otherwise herein.

FIG. 8 illustrates from a top view perspective the toilet bowl seat sub-assembly 101 (i.e., the toilet assembly 100 minus the tank and other upright components), demonstrating the manner in which the rod 16 of FIG. 7 may be configured to substantially encircle an entirety of the inside bowl 5. In certain embodiments, the rim cover 11 may be likewise provided around—so as to substantially encircle—an entirety of the inside bowl 5 and the rim 3. In other embodiments, however, the rim cover 11 may be provided at only certain periodic (i.e., high-risk of stain) portions of the rim 3, as may be desirable. With reference momentarily to FIG. 10, one or more hooks 17 or clasps may also be provided, so as to maintain the loop of the rod 16 during use (i.e., upon placement within the bowl and/or upon threading a portion of the rim cover 11 thereon, as will be described elsewhere herein.

FIGS. 9 and 10 illustrate another exemplary embodiment, much like that of FIGS. 7-8, which utilizes a wire loop 18, as compared to the rod 16 (i.e., spring tension-based) previously described herein. The wire loop 18 may, in certain embodiments, not be spring tensioned like the rod 16; instead, the wire loop may be configured to otherwise adhere to, grip, and/or otherwise selectively secure the rim cover 11 relative to the inside bowl 5 of the toilet assembly. In at least the illustrated embodiment, a plurality of barbs 19 are provided on at least a portion of the outer surface of the wire loop 18. The plurality of barbs 19 are thus positioned for and configured to grab only and retain a portion of the rim cover 11 that is draped adjacent thereto. As commonly known and understood in the industry, the barbs 19 may come in a variety of shapes and sizes, whether triangular in shape, thorn-like, or otherwise. In at least one embodiment, so as to minimize orientation difficulties, the plurality of barbs 19 may be provided on substantially an entirety of the outer surface of the wire loop 18. It should also be understood that a plurality of barbs 19—while illustrated here relative to the wire loop 18—may also be provided on at least a portion of the rod 16 of FIG. 7, thereby providing an embodiment in which a combination of barbs and spring-loaded tension contribute collectively to retention of the rim cover 11, as desired.

FIGS. 11-13 illustrate another exemplary embodiment of the rim cover 11 (as also applicable to the skirt 12 described elsewhere herein). As may be seen, in certain embodiments of this type, the rim cover 11 (and/or skirt 12) may be further provided with a valence-type opening 20. Through this opening, the rod 16 may be selectively threaded prior to positioning of the rim cover 11 (and/or skirt 12) adjacent the rim 3 (and/or base 1) of the toilet assembly, as detailed elsewhere herein. As illustrated in FIG. 12, the valence-type opening 20 may be provided at one end of the rim cover 11, particularly that configured for positioning adjacent an edge of the inner rim 4 and the water flush channels 6 (see FIG. 7). In this manner, via the embodiment of FIGS. 11-12, the valence-type opening 20 in combination with the rod 16 may be configured to securely retain and position the rim cover 11 so as to ensure no blockage of the channels 6 occurs.

As also mentioned, the opening 20 may also be provided on a portion of the skirt 12, so as to retain the same relative to the base 1 of the toilet assembly, as will be described elsewhere herein. FIG. 13 is informative in this respect, illustrating one embodiment of the skirt 12 incorporating a valence-type opening 20 thereon. A second mounting assembly (i.e., an outer tension rod or elastic rod 22, as referred to specifically elsewhere herein) may be provided for passage through the opening 20, so as to retain the skirt 12 against the base 1 of the toilet sub-assembly 102. It should be understood that, in contrast with the rod 16 configured for placement within the inside 5 of the bowl and to retain the rim cover 11 therein, the rod 22 is, according to various embodiments, oppositely biased, so as to press the skirt 12 against the base. In certain embodiments, although not illustrated in FIG. 13, but as described elsewhere herein, a clasp or other attachment mechanism may be provided, so as to retain the rod 22 around a substantial entirety of the circumference of the base 1.

As illustrated in FIG. 13, it should also be understood that the skirt 12 may be sized and shaped in certain embodiments so as to cover not only the base 1 of the toilet assembly (including base bolts 1B), but also a portion of the floor 23 surrounding the toilet assembly. In this manner, whether a mat 13 (see FIG. 4) is provided or not in a particular embodiment, some degree of coverage is provided, so as to impede staining and/or urine splashing upon the floor 23. It may also be understood, by analogy to the rim cover 11, that the skirt 12 of FIG. 13 may include on at least a portion thereof an adhesive layer 15 (not illustrated in FIG. 13), such that the skirt 12 may be—as a non-limiting example—adhesively retained against the floor 23.

FIG. 14 illustrates yet another embodiment, wherein relative to the skirt 12 a separate base skirt extension 13B is provided, so as to obtain additional coverage of the floor 23 area surrounding the toilet assembly. Although not illustrated in FIG. 14, it should be understood that, relative to the extension 13B, the skirt 12 may be configured to drape there-over, such that the skirt extension 13B lies partially under the skirt, in a sort of "shingle-like" fashion. In those embodiments further incorporating a mat 13, the skirt extension 13B may likewise lie partially under the mat 13; in other embodiments, the skirt extension may overlay a portion of the mat. As illustrated, according to various embodiments, the skirt extension 13B may be provided with an adhesive layer 15, so as to retain and selectively attach the same relative to the base 1 of the toilet assembly and/or to the floor 23. Although the adhesive layer 15 is illustrated as covering an entirety of a lower surface of the extension 13B in FIG. 14, it should be understood that in certain embodiments, only a portion of the lower surface may contain an adhesive layer.

FIG. 15 illustrates once more the toilet bowl assembly 100, the seat and lid hinges 10, and an exemplary pre-flush water level 43 within the inside 5 of the toilet bowl. It should be understood that, as commonly known and understood in the industry, the water level 43 may vary to some degree amongst distinctive toilet bowl assemblies; however, the level is always a certain degree below the rim 3 of the assembly so as to prevent overflowing thereof. In at least the illustrated embodiment of FIG. 15, the water level 43 is such that the inside 5 bowl is approximately half full pre-flush. The importance of this water level 43 may be understood with reference to the illustrations following FIG. 15, as described in turn below.

In FIG. 16, with the toilet seat 7 raised, there is illustrated in a partial cross-sectional view, an exemplary seat hinge and rear rim cover sheet 24 that is provided according to various embodiments. As illustrated, the cover sheet 24 is provided independent of the rim cover 11 described previously and elsewhere herein; it should be understood, though, that the two may be provided in combination with—and thus in a complementary manner relative to—one another. FIG. 17 illustrates, with the toilet seat 7 down, a partial cross-sectional view, again of the exemplary seat hinge and rear rim cover sheet 24 that will now be described in further detail. Notably, as illustrated in both of FIGS. 16-17, whether the seat 7 is raised or lowered (i.e., down), the cover sheet 24 in its entirety is shaped and sized so that it is—in its entirety—spaced a predetermined distance above the water level 43. This is to ensure that no portion of the cover sheet 24 ever comes in direct contact with the water within the inside bowl 5 during use thereof.

FIGS. 18-20 illustrate the cover sheet 24 in isolation, as provided according to several distinct embodiments. In FIG. 18 there is illustrated the approximate shape of the cover sheet 24 provided according to various embodiments. Opposing edges may be arcuate in shape, so as to accommodate the rim 3 of the toilet assembly when the seat 7 is lowered. In this respect, in certain embodiments, pre-cut slits 24A may also be provided on opposing sides of the cover sheet 24, so as to further improve fit of the cover sheet 24 within the rim 3 when the seat is lowered. As illustrated, the cover sheet 24 is substantially rectangular in shape; it should be understood, though, that the cover sheet may be other-wise shaped, whether pyramidal, square, oval, or the like, provided that each shape is sized and configured such that no portion of the cover sheet 24 contacts the water level 43, even when the seat 7 is in the lowered orientation.

In FIG. 19, there is illustrated another embodiment of the cover sheet 24 of FIG. 18, having thereon a set of wing extensions 25. Generally speaking, the wing extensions 25 are configured to extend an area of protective coverage of the rim 3 and the rim wall 4, at least at a rear portion of the inside 5 of the toilet bowl near the hinges 10. In certain embodiments, the wing extensions 25 may be angled and provide a surface area that is likewise angled relative to an area of the cover sheet 24 itself (see FIG. 18 by comparison). In certain embodiments, the arcuate edges of the cover sheet 24 of FIG. 18 may be replaced with pre-scored and/or bend lines 24B, so as to facilitate movement of the extensions 25 in such a manner that they hang within the inside bowl 5 of the toilet assembly when the seat 7 is in the lowered orientation.

Referencing FIG. 20, it may be understood that the cover sheet 24 may, according to various embodiments, be provided with an adhesive layer 15. In certain embodiments, the adhesive layer 15 may be provided on only a portion of the cover sheet 24, namely the portion adjacent and attached to a lower surface of the seat 7 (see FIG. 16 once more). In this manner, the remaining portions of the cover sheet 24 avoid any impediment to their movement alongside the rim 3 as the seat 7 is moved from the open to the lowered orientation (and vice versa). Beyond the details understandable from FIG. 20, it should also be understood that the cover sheet 24 (and the extensions 25) may be made from any of the materials listed and detailed previously herein with respect to the rim cover 11 and/or the skirt 12. In this manner, in certain embodiments, the cover sheet 24 and/or the extensions 25 may also be variably disposable, as desirable for particular users thereof. In at least one embodiment, a thickness of the cover sheet 24 and/or the extensions 25 may be thicker than that of the rim cover 11 and/or the skirt 12, at least in part due to the hanging nature thereof, as compared with the draping associated with the rim cover and/or the skirt. In still other embodiments, the thickness of material for all of these features may be substantially the same. In those and still other embodiments, the material may differ amongst each of the respective features; in at least one embodiment, though, the material may be substantially the same for all features.

FIGS. 21-22 illustrate another exemplary embodiment of a rim cover 11, wherein a gathered elastic-type attachment 26 is provided intermediate distinct cover panels 27 that form—collectively—the rim cover. The material of the panels 27 may be any of the examples previously described herein, relative to the rim cover 11. Contrasted with the pre-scored or bending lines 14 that may be provided on the rim cover 11 according to certain embodiments, the embodiment illustrated in FIG. 21 (and other embodiments) may utilize a gathered elastic-type attachment 26 so as to provide the same gathering or bending characteristics, resulting in a substantially "U-shaped" rim cover 11 that substantially corresponds with the "U-shape" of the rim 3 and associated side surfaces. The gathering attachment 26 may constrict the panels 27, thereby tightening the same relative to one another and thus serving to retain the cover 11 relative to at least the rim 3. The gathering attachment 26 may be utilized independently of or in combination with any other features or attachments for the rim cover 11 as described elsewhere herein.

FIG. 22 illustrates the embodiment of FIG. 21 (with respect to the rim cover 11), as placed upon a toilet assembly according to various embodiments. Also illustrated in FIG. 22 is a skirt 12 that similarly comprises a distinct panel 27 and a gathered elastic-type attachment 26. In contrast with the configuration of the rim cover 11, that of the skirt 12 in FIG. 22 illustrates only a single gathered attachment 26, which in at least the illustrated embodiment is provided at one edge of the skirt 12, namely that intended for placement and retention relative to the base 1 of the toilet assembly. Before gathering, the skirt 12 may thus have a diameter of opening greater than the circumference of the base 1; upon gathering via the attachment 26, though, the skirt 12 may be constricted such that the diameter of the central opening thereof is less than the circumference of the base, thus retaining the skirt 12, in part, relative to the base.

FIG. 23 introduces a cover assembly 24C, which according to various embodiments may be defined by a combination of a rim cover 11 and a cover sheet 24, both as previously described herein. Indeed, in certain embodiments, the two distinct components may be provided as an integrated unit, thus defining the cover assembly 24C that will now be described. FIG. 24 illustrates one exemplary embodiment of such a cover assembly 24C. In at least the illustrated embodiment, the assembly 24C includes a cover sheet portion 24A, which may be considered substantially analogous to the cover sheet 24 described previously herein, and a plurality of rim cover panels 11A-C, which may collectively be considered substantially analogous to the rim cover 11 described previously herein. Indeed, the material of the cover assembly 24C may be any of the examples provided previously herein relative to the rim cover 11 and/or the cover sheet 24 and/or even the skirt 12.

Remaining with FIG. 24, it may be seen that the cover assembly 24C may include a set of fold or pre-scored lines 11F (analogous to the lines 14 described previously herein). Also provided is at least one fold line 11Z, which is configured to enable folding up of a portion of the cover sheet portion 24A when the seat is in the raised orientation. One of the fold lines 11Z is also configured, at least in the illustrated embodiment of FIG. 24, to facilitate bending of portion rim cover portion 11B downward, as previously described (see also FIG. 6). For purposes of comparison, it may be seen that in contrast with the "single piece" configuration of the cover assembly 24C in FIG. 24, the embodiment illustrated in FIG. 25 may be otherwise configured with at least one cut line 11X. With a cut along line 11X, a portion of the cover sheet portion 24A may be folded (along fold line 11Y) vertically upward when the toilet seat 7 is in a raised orientation. Portion 24B of the cover sheet remains unfolded and attached relative to at least portion 11B of the panels constituting the rim cover 11 component of the cover assembly 24C. This may be understood also with reference to FIG. 26.

To expand upon FIGS. 24-26 further and in particular the assembly 24C and the manner in which it may combine components of the rim cover 11 and the cover sheet 24, it should be understood that, in certain embodiments, the rim cover can be used "as-is" by simply continuing to fold into section 11A/24A further along the 11A/11B fold line. Recall once more that 11B is the folded vertical wall covering the inside vertical rim 4, as previously described herein. In other embodiments, cover section 11A/24 (see 24B and 24D in particular) may be partially separated from section 11A by cutting (or separating along an as-received cover perforation and/or slit). Relative to lines 11Z (see FIG. 24), it should be understood that in still other embodiments, section 11A/24 (generically referred to) can be separated from sections 11A/B by cutting along one of the lines 11Z (or 11X, in FIG. 25) or by cutting along both lines of FIG. 24, which would result in a configuration as in FIG. 27, as described below.

Turning now to FIG. 27, another embodiment of a cover assembly 24C may be seen, whereby a cover sheet portion 24D is provided, as compared to the cover sheet portion 24A described previously herein. As illustrated, there is no "single piece" configuration in this embodiment (see also FIG. 28); instead the rim cover panels 11A-C (with their respective fold or pre-score lines 11F) are provided with an edge complementary to an adjacently positioned edge of the cover sheet portion 24D. In this manner, when placed adjacent to one another, full coverage is nevertheless provided, as compared to the cover assembly 24C of FIG. 24. In contrast, though, movement of the seat 7 and thus the cover sheet portion 24D is not constrained in any way by an operative connection (i.e. a bend line or the like) between the two respective components, as may be desirable in certain scenarios. For purposes of perspective, FIG. 29 is provided, illustrating the cover assembly 24C of FIGS. 24-27, as positioned on a toilet assembly relative to one another, when the seat 7 is in the raised orientation.

FIG. 30 illustrates in isolation yet another embodiment of the rim cover 11 portion of the cover assembly 24C (whether provided independently or in combination therewith). In this particular embodiment, at least the cover portion 11A, which lies atop the rim 3 (see FIG. 6) is provided with two cut-out portions 11Q, so as to accommodate the hinges 10 within a perimeter of the rim cover 11. In the illustrated and other embodiments, a portion 11S of the rim cover 11 may remain flat atop the rim 3 of the toilet assembly even when the seat 7 is in the raised orientation, thereby with the opposing outer portions protecting and covering the rear "gap" area that is under the seat 7 when the seat is in the raised orientation. Coverage may also thus be provided adjacent the edges of the hinges 10, an area also prone to contamination and staining in conventional configurations.

FIG. 31 illustrates in isolation yet another embodiment of the rim cover 11 portion of the cover assembly 24C (again, whether provided independently or in combination therewith). In this particular embodiment, at least the cover portion 11A, which lies atop the rim 3 (see FIG. 6) is configured to be folded vertically along additional fold line 11F (i.e., along the Z plane as illustrated). In this manner the hinges 10 are fully covered and thus protected by a portion of the rim cover 11A when the seat 7 is in the raised orientation. This particular embodiment, it should be noted, is thus able to provide protection of the hinges 10 and the area surrounding the same, even without utilization of an accompanying cover 24, as described elsewhere herein.

Turning now to FIG. 32, illustrated therein is an exemplary cover assembly 24C, as may be provided according to various embodiments during a production or manufacturing stage (i.e., pre-use thereof on a toilet assembly 100). In various embodiments, a tab 24T may be provided, for easy removal of certain components, namely the exterior base 11H (see FIG. 45) after use. Portion 11G may also be removed upon use, such that the lines between the same and portion 11B may be perforated and/or otherwise pre-scored for punching out of portion or panel 11G, upon use. Separation may be similarly provided between base 11H and portion or panel 11C. In this manner, the cover assembly 24C as illustrated—and as described elsewhere herein—may be mass produced as a single integrated component, from which distinctive parts and/or sub-components (e.g., rim cover 11, cover 24, or the like) may be selectively removed. Relative to the hinges 10, also illustrated, it should be understand that the embodiment of FIG. 32 (and FIG. 45 by analogy) may incorporate there-around any of the embodiments previously described herein, whereby for example a portion of the cover panel 11A may be folded upward along the Z plane, cut-outs may be provided for surrounding hinge area coverage, or the like.

FIGS. 33 and 34 are provided to illustrate in front and side views, in addition to the rim 3 and the inner side 4 and the outer side 28 of the toilet bowl assembly, a bottom outer ledge 29 thereof, as commonly known and understood in the industry as being present on certain toilet bowl assemblies. FIGS. 35A-36B thus illustrate various embodiments of retention mechanisms that may be utilized in conjunction with the rim cover 11 (or with the rim cover portion of the assembly 24C described previously herein). Analogy may be made to the rods and the like of FIGS. 7-9 (also described previously herein), with the distinction being positioning of the mechanisms of FIGS. 35A-36B adjacent the bottom outer ledge 29, as compared to the placement of the mechanisms of FIGS. 7-9 adjacent the bottom inner ledge (i.e., within the inside bowl 5 of the toilet assembly).

FIG. 35A in particular illustrates an exemplary and generic band 31 that may be provided according to various embodiments adjacent the bottom outer ledge 29 of the toilet base 1. In the illustrated embodiment, the band 31 is partially "L-shaped;" however, it may be otherwise shaped (see e.g. FIG. 36A by comparison), provided the band 31 is configured to engage the ledge 29 and an associated rim cover 11 (see e.g., FIG. 35B by way of analogy). The band may be made from any of a variety of materials and, as a non-limiting example, may be attached adjacent the bottom outer ledge 29 via use of an adhesive layer 15 (not illustrated). Of course, the band may be otherwise removably attached to the toilet base 1, via any of a variety of attachment mechanisms, as commonly known and understood in the industry.

FIG. 35B illustrates a rod 30A that is substantially analogous to the rod 16 described previously herein and the wire loop 18 described elsewhere herein, at least with respect to materials from which it may be formed. Notably, the rod 30A similarly may—in certain embodiments—include a plurality of barbs, which may be sized, shaped, and/or placed along an outer surface of the rod 30A in substantially the same manner as the barbs 19 described previously herein. Notably, by way of comparison with FIG. 36B, the rod 30A (like the band 31A) are, at least in part, in direct contact with the toilet base 1. Stated otherwise, as may be understood from FIG. 35B, the rim cover 11, when draped over the rim 3 of the toilet assembly passes atop/over the rod 30A (instead of under the rod, as in FIG. 36B, by way of contrast).

FIG. 36A illustrates an alternative band 31B, which may not only be shaped other than "L-shaped," but also configured to engage an outer surface of the rim cover 11. This embodiment may be contrasted with the embodiment of FIG. 35A, wherein the band 31A (which may include barbs as well, as illustrated) is positioned intermediate the toilet bowl base 1 and the rim cover 11. FIG. 36B illustrates yet another exemplary rod 30B, which may be configured according to various embodiments to retain the rim cover 11 intermediate the rod and the toilet bowl base 1.

The placement of the rods 30A/B around the toilet bowl base 1 and adjacent the rim 3 may be understood further with reference to FIG. 37. One advantage of the rods lies in that they need not necessarily extend around a substantial entirety of the circumference of the base; instead, they may be biased to engage the base via tension or otherwise. This is also true, in certain embodiments, relative to the bands 31A/B, although as may be understood with reference to FIG. 38, the bands 31A/B may extend not only around the substantial entirety of the circumference of the base 1 adjacent the rim 3, but also further behind the back of the toilet assembly, whereby the bands 31A/B may be closed via a rear fastening mechanism 32 (e.g., a fastener, a bracket, a clasp, or the like, which may be substantially analogous to the clasps and/or hooks 17 described previously herein).

FIGS. 39-40 illustrate—from respective front and side views—yet another feature provided according to various embodiments of the toilet assembly 100, particularly with respect to the base 1 thereof. Specifically, a dispenser/container 33 may be provided, within which a "roll" of covers (i.e. rim covers 11 and/or skirts 12) may be housed. In certain embodiments, the dispenser/container 33 may be available commercially as an integrated housing or the like, so as to be disposable upon emptying thereof; in other embodiments, the dispenser/container 33 may not be configured to be disposable, but instead re-Tillable with more "rolls" of covers, as needed. In certain of these and still other embodiments, the dispenser/container 33 is made from a non-corrosive, cleanable material, such as a polymer, plastic, or the like.

FIGS. 41A-B illustrate exemplary dispenser/containers 33 from a top view. As may be understood from these illustrations, the dispenser/container 33 may extend around at least a part of the circumference of the base 1 of the toilet assembly. FIG. 41A in particular illustrates an embodiment with at least one slit 34A formed in a top of the dispenser 33, for selective retrieval (i.e., pulling out, rolling out, or the like) of pre-folded rim covers 11 and/or skirts 12. In certain embodiments, the covers 11 and/or skirts 12 may be in a pre-folded configuration, much like facial tissues, body wipes, or the like. Of course, the covers 11 and/or skirts 12 may be provided in any of a variety of forms, whether within the dispenser 33 or otherwise (see also FIG. 32).

As FIG. 42A-C illustrate, various methods of attachment of the dispenser 33 may be provided. In FIG. 42A, the dispenser 33A illustrated therein may be pre-formed from a flexible material, such that it may be pre-formed and biased inward. Opposing flange portions of the dispenser 33A would thus—in at least this embodiment—need to be pulled or otherwise moved outward (i.e., toward a more "U-shaped" configuration) when the dispenser 33A is being placed around the base 1 of the toilet assembly. So configured, the dispenser 33A may be held/retained against the base 1 via tension imposed by the biasing of the opposing flanges back inward (as illustrated).

FIG. 42B illustrates another exemplary dispenser 33B, which unlike that of FIG. 42A is not biased inward, but instead is substantially "U-shaped" in its original form. As with other components described elsewhere herein, a portion or all of at least one surface of the dispenser 33B may be provided with a layer of gripper material, such as rubber or polymer, 15B, by way of which the dispenser 33B may be selectively attachable to (i.e., engage with) the base 1 of the toilet assembly. In certain embodiments the gripper layer 15B may be configured to permit selective removal of the dispenser 33B after a period of time, for example where the dispenser may be disposable in nature; in other embodiments, the adhesive characteristics of the gripper layer 15B may be relatively high in strength, so as to secure the dispenser 33B for a long period of time and to prevent detachment even under imposition of a force, for example, as may be imposed upon a user dispensing, pulling out, or otherwise removing a pre-folded rim cover 11 or skirt 12 from the dispenser.

FIG. 42C illustrates yet another exemplary dispenser 33C, which in contrast to those of FIGS. 42A-B may be retained against (i.e., in contact with) the base 1 of the toilet assembly by a band 31 extending substantially around the base of the toilet assembly. The band 31 may be used in conjunction with a fastening mechanism or clasp 32. In certain embodiments, the dispenser 33C may be retained/secured to the base in the same manner as may be the skirt 12 and/or other components, as described previously herein (see e.g., FIGS. 36A-B and 38).

Within FIGS. 43 and 44 may be seen an exemplary box of covers 36 (i.e., another dispenser of sorts), which may be provided on rollers for easy pulling out thereof, analogous to the way in which aluminum or tin foil may be removed from its associated container. For purposes of supporting the box 36 or "roller dispenser" illustrated in these embodiments, there may be provided a set of brackets 35, configured to "hang" over the rim 3 of the toilet assembly. In certain embodiments, the set of brackets 35 may be provided underneath a previously-installed rim cover 11, whereby upon removal thereof (i.e., when disposed of once soiled), a new rim cover 11 (and/or skirt 12) may be pulled or otherwise removed, via a rolling and pulling motion, from the box or "roller dispenser" 36. According to various embodiments, the box 36 may be made from a variety materials, as described previously herein with respect to dispenser 33C; the set of brackets 35 may also be constructed of non-corrosive materials, or the like, similar also to previously described components, including the dispenser 33C.

As may be understood from FIG. 44, according to various embodiments, a single dispenser 36 may be provided in any particular scenario, such that upon dispensing of—for example—the rim cover 11, the same may be pulled upward and over the rim 3 of the toilet assembly. With reference to prior drawings described herein, certain elements may then be "punched out" or removed, as also evident in FIG. 45. For example, upon removal or "rolling out" of an exemplary rim cover 11 (whether as an assembly 24C or otherwise), at least the interior portion 11G (above the inside bowl 5) and the exterior portion 11H may be punched out, perforated, or otherwise removed. The remaining configuration would include panels 11A-C and/or some combination of the cover sheet 24—and/or one of the various embodiments thereof described previously herein with respect to at least FIGS. 24-28 and 30-31.

Turning now to FIG. 46 and certain figures following the same, described are various possible surface texturing, stippling, impregnating, and the like, as may be applied according to various embodiments with respect to any of the components previously described herein. Such may include, as non-limiting examples, not only the rim cover (as illustrated in FIG. 46), but also the cover assembly 24C, the skirt 12, and/or the like. In FIG. 46 in particular, an exemplary rim cover 11 is illustrated, with different portions thereof having provided thereon different possible surface features. It should be noted that one rim cover 11 may, in certain embodiments, include multiple surface features; however, any combination of the features illustrated may be provided, as desirable. It should also be noted that removable portions of the rim cover 11 (e.g., portions 11G and 11H, if present) will typically have no surface features thereon.

As one option, FIG. 46 illustrates impregnations 39, which may be provided on a surface of the rim cover 11 or otherwise within or as part of one or more layers thereof. The impregnations may be configured, in certain embodiments to enhance absorption characteristics of the rim cover 11 (or other components) by increasing the surface area exposed. Shown alternatively are exemplary surface coatings 38, and surface textures 37. Orientations thereof whether oval or pyramidal or otherwise shaped—may be seen also in FIG. 47, which illustrates from a perspective view how the textures 37 (and/or other surface features) are located atop at least one surface of the rim cover 11. It should be noted, though, that not an entirety of any particular surface need to be covered; instead, only a portion thereof may be provided with surface textures, coatings, or the like, so as to—for example, increase surface area only in those areas considered "high risk" and/or otherwise highly likely to face contamination or soiling.

FIGS. 48A-48B and 49 illustrate further various possible surface features, along with certain possible internal features, as may be provided as part of an exemplary rim cover 11 (or, not illustrated, a skirt 12 or a cover assembly 24C or the like) according to various embodiments. As may be understood from FIG. 48, where a multi-layer rim cover 11 may be provided according to various embodiments (versus merely a single- or a bi-layer cover), different layers may be configured differently. As a non-limiting example, surface coating(s) 38 may first be present, followed by surface impregnations 39 (for example, within a top/surface layer), followed further by a barrier layer 41, followed further by an adhesion layer 42 (analogous to adhesive layer 15 described elsewhere herein). FIG. 48B illustrates surface textures 37 (pyramidal, by way of non-limiting example) in place of coating(s) 38, while FIG. 49 shows how different portions of a single rim cover 11 may contain either or both or neither of these exemplary features in the case of multi-layer embodiments.

FIGS. 50A-50E return once more to the toilet bowl subassembly 102 and the water level 43 contained therein, as discussed briefly previously herein with respect to FIG. 15. Referencing first FIG. 50B, it may be understood the manner in which urine stream spray or splatter may impinge upon various surfaces of the toilet assembly, including directly into the water at the water level 43, for example via stream 44 and directly onto the rim 3 or inner rim 4 surface(s), for example via stream 45. The various embodiments of rim covers 11, assemblies 24C, skirts 12, mats 13, and the like, as described herein are each configured to protect not only against such direct impingement, but also against indirect impingement of urine—illustrated by way of non-limiting example in at least FIGS. 50C and 50D. In FIG. 50C, indirect impingement may occur via stream 46, for example due to splashing of contaminates and/or urine off the water level 43 and back onto the rim 3 or other associated surfaces. Notably, where a rim cover 11 as described herein according to various embodiments is utilized, not only is protection provided against direct impingement, but also against this type of indirect impingement. FIG. 50D illustrates direct and indirect impingement on the rim 3 and the floor 23 (i.e., due to splatter off the rim 3 or outer rim surface 28 or the like).

Recognizing that the various rim covers 11, assemblies 24C, skirts 12, mats 13, and the like as described elsewhere herein provide focused and distinct coverage to protect against both direct and indirect impingement, FIG. 50E illustrates a frontal "bib sheet" 11K, which may be provided according to various embodiments so as to provided extended and continuous coverage of the bowl outer surface 21. The bib sheet 11K may be used independently, or in combination with any of a variety of skirts 12 (not shown in this particular figure) and/or mats 13. According to various embodiments, the bib sheet 11K may be made from any of the exemplary materials described elsewhere herein with respect to—for example—the rim cover 11. In contrast with the rim cover, though, the bib sheet may provide protection for a larger surface area, in particular lower around the outer surface 21 than that achievable via the rim cover alone.

FIGS. 51 and 52 address another area prone to indirect impingement that is not directly protected by any of the rim covers 11, skirts 12, assemblies 24C, or the like, as described elsewhere herein. Notably, in certain instances, direct and/or indirect urine or contaminant impingement may occur while the seat 7 is in the lowered position (i.e., when a user is sitting on the seat, versus standing in front of the toilet assembly). Thus provided is a lower surface cover 49, configured to attach to the exposed lower surface 48 of the seat, which extends beyond the rim 3 (see FIGS. 51 and 52 in combination). The cover 49 may have an adhesive layer, analogous to that of the rim cover 11 described elsewhere herein in certain embodiments. In those and still other embodiments, the cover 49 may have a surface area substantially the same as that of the lower surface 48 of the seat 7. In certain embodiments, cut-outs may be provided for the seat rests 7B, whether via perforations or the like, also analogously to as described elsewhere herein in the context of the rim covers 11, assemblies 24C, skirts 12, and the like.

FIGS. 53A-D illustrate various bands 50 and 51A-C, as may be provided according to various embodiments, which may be understood substantially by analogy to the bands and the like described previously herein with respect to at least FIGS. 35A and 36A. For instance, according to certain embodiments, the band 50 may be adhered (e.g., via an adhesive layer 54 or the like) to the inner rim side 4 and adjacent the rim 3. Barbs may be provided, as may be understood relative to the band 51B of FIG. 53C. Differing shapes, whether planar, L-shaped, C-shaped, or the like may also be provided in various embodiments, with reference also to the band 51C of FIG. 53D. As illustrated, by way of non-limiting example, in FIG. 53C, the bands 50 and 51A-C may—analogous to other bands, rods, and the like described elsewhere herein—be configured to retain and/or otherwise selectively retain the rim cover 11 adjacent the rim 3.

Exemplary placement of the bands 50 and 51A-C within the inside bowl 5 of the toilet assembly may be understood from FIGS. 54A-B, also by way of analogy to previously described bands, rods, and the like. Of particular note, as illustrated in FIG. 54B, the bands 50 and 51A-C may be retained against a surface of the inside bowl 5 or rim side 4 not only via adhesive but also (or alternatively) via a fastening mechanism 53 (e.g., a clasp or the like, as also described elsewhere herein).

Highlighting the water flush channels 6 previously described herein (see FIG. 7), FIGS. 55-59B illustrate various configurations for providing an offset of the mounting (or attachment) of the rim cover 11 (and/or associated assembly 24C components) adjacent the rim side 4. Specifically, FIGS. 55-56 illustrate a set of tension rod standoffs 55, which may form a sort of frame 56 (optionally with barbs) against or to which any of the bands, rods, or the like may be attached. As may be understood with reference to FIGS. 55 and 56 in combination, the stand-off legs 55 are periodically spaced and thus not continuous in nature around the circumference of the inside bowl 5 and inner rim 4; as a result, according to various embodiments, the stand-off legs 55 provide placement of the frame 56 (and thus the draping of the rim cover 11) in such a manner that the channels 6 remain unimpeded for water flow there-through and into the inside bowl 5. As compared to other mounting bands, rods, or the like described elsewhere herein, it should be understood that the stand-off legs 55 illustrated in these figures and provided according to various embodiments are configured to provide a greater degree of stability for the rim cover 11 and associated bands, rods, and the like.

Bearing this in mind, FIGS. 57-58 illustrate yet another frame-containing embodiment, wherein still further stability and structure is provided, while also maintaining a substantially unimpeded flow of water through the channels 6. As compared with the stand-off legs 55 and the frame 56 of FIGS. 55-56, the configuration in FIGS. 57-58 utilizes a dual-sized frame 57, such that any "legs" analogous to those of FIGS. 55-56 extend between and are attached—at both ends to elongate members of the frame that extend along a circumference of the inside bowl 5 or inner rim side 4. This may be understood particularly with reference to FIG. 58. Notably, according to various embodiments, the frame 57—like the frame 56—provides a certain degree of rigidity and an offset relative to the inside bowl 5, so as to ensure a pathway for water from the flush channels 6 to the water level 43 remains unimpeded, even when the rim cover 11 (or analogous components) are draped over the rim 3.

FIGS. 59A-B illustrate a wire loop frame 58, which may be further contrasted with the tension rod-type frame 57 of FIGS. 55-56. The wire loop frame 58—in an analogous fashion to other loops and bands described elsewhere herein—is according to various embodiments not biased or tensioned in any particular way relative to the toilet assembly. Instead, as FIG. 59B illustrates a fastening mechanism 53 (e.g., a clasp, hook, or the like—also as described elsewhere herein) may be utilized to retain the complete "loop" of the frame 58. Still further, in at least the embodiment illustrated in FIG. 59B, by way of example, a plurality of barbs 52 may be provided on the frame 58. Such barbs may indeed be provided on any of the frames, legs, and/or analogous components—all as described elsewhere herein—according to various embodiments.

Turning now to FIGS. 60-64, a variety of elastic or Bungie cord containing embodiments are illustrated and now described, whether relative to a rim cover 11, a skirt 12, and/or a combination thereof or of another assembly such as assembly 24C. FIGS. 60-62 in particular illustrate an exemplary elastic or Bungie cord 60 that may be incorporated as part of the skirt 12, whether in an analogous fashion as the valence opening attachment 20 (see FIG. 11) or otherwise. It should be understood that the elastic or Bungie cord mechanism 60 is configured, in certain embodiments to bias or constrict the skirt 12, so as to retain and/or selectively secure the same against/around the base 1 of the toilet assembly. As illustrated in FIG. 62, it should be understood that a fastening mechanism 61 (e.g., a hook (as illustrated), a clasp, or the like) may be utilized in conjunction with the elastic or Bungie cord like component 60, as may be desirable for certain embodiments, so as to ensure slippage relative to the base 1 is minimized and/or effectively eliminated.

FIGS. 63-64 illustrate an elastic or Bungie cord 60 mechanism as applied to a rim cover 11 (versus a skirt 12 as in FIGS. 60-62). Again, a fastening mechanism 61 such as a hook or clasp may be utilized to retain/secure the cord 60. Instead of a cord, the elastic or Bungie-like mechanism may be provided in the shape and/or form of a flexible band 62, also as such bands have been described elsewhere herein. Additional cross-sectional views of the cords 60 and bands 62 are provided in FIGS. 65A-B, while FIG. 66 illustrates another exemplary clasp 32 for retaining the cords and/or bands according to various embodiments.

Figure 67A:
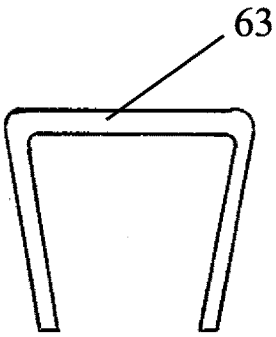
Figure 67B:
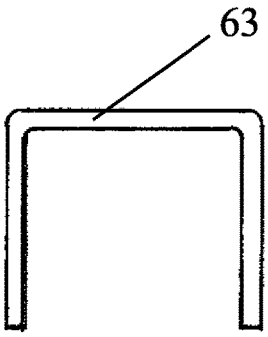
Figure 68A:
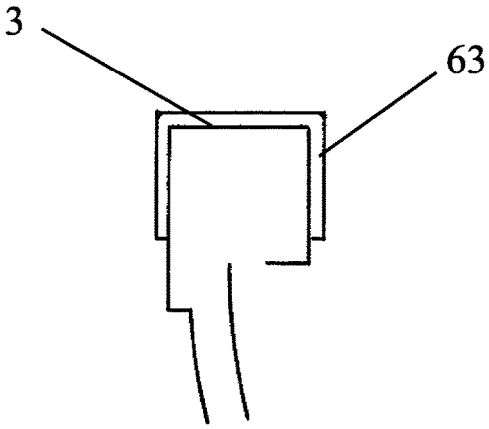
Figure 68B:
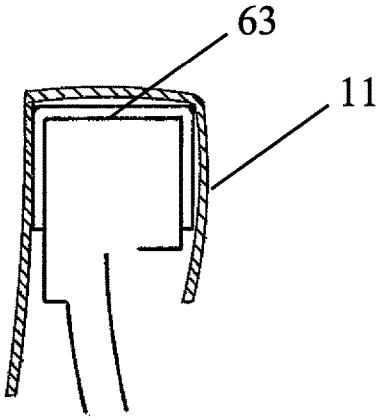
Figure 68C:
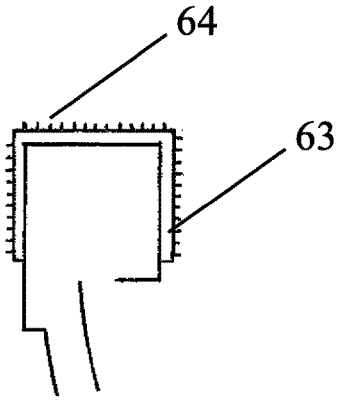

Various bands, cords, rods, and the like have been described throughout herein; however, FIGS. 67A-68C illustrate a non-limiting and exemplary set of rim-frame components that may be instead (i.e., alternatively) incorporated into various embodiments, so as to retain or otherwise secure a rim cover 11 (or an assembly 24C) relative to a rim 3 of the toilet assembly. In particular, FIGS. 67A-B illustrate a rim frame 63, configured to attach relative to and substantially cover the rim 3, the inner rim side 4, and the outer rim 28. As illustrated, the frame 63 may be substantially U-shaped, biased as in FIG. 67A so as to ensure engagement with the rim-related surfaces, or provided with an adhesive layer as in FIG. 67B and unbiased. FIG. 68A illustrates the frame 63 upon attachment to the rim 3, while FIG. 68B illustrates further manner in which the rim cover 11 may be draped over and thus engage with the frame as opposed to with one or more of the surfaces of the rim, as described elsewhere herein. In certain embodiments, as illustrated in FIG. 68C, the frame 63 may be provided with a plurality of barbs 64, so as to enhance engagement between the frame and the rim cover 11. It should be understood that the frame 63 may be made from any of a variety of materials, including non-corrosive and/or flexible materials of any type, including those previously detailed elsewhere herein.

FIGS. 69 and 70 further illustrate exemplary frames 63, including ones with a plurality of barbs 64 thereon, from respective top and side views of the toilet bowl assembly. It should be noted that in certain embodiments the barbs 64 may indeed be any of a variety of surface features, including impregnations, stippling, texturing, and the like, all as previously described herein relative to the rim cover 11 and associated components. In this manner, it should be understood that the rim cover may be configured to provide an increased surface area to not only engage and retain/secure the rim cover 11 when in place, but also to absorb any contamination that may occur when a rim cover is not being utilized. In this respect, in certain embodiments, the frames 63 may be constructed so as to be disposable, whether after a period of days, weeks, months, or any predetermined frequency, as may be desirable.

Which brings us to FIGS. 71-72, wherein an alternative type of cover 69 (analogous in substantially all ways to the rim cover 11 and/or assembly 24C described elsewhere herein), which may contain a treatment thereon of dye, so as to result in a dye-treated cover 69. In certain embodiments, as compared to a clean rim 67, a rim may be treated with a dye-containing substance or otherwise be provided with a dye-containing surface 68, such that when contaminants or the like are present, dye spots 70 appear. Perhaps more useful in the context of embodiments described elsewhere herein, dye treatment may be provided on any of the rim covers (e.g., rim cover 66) described previously, such that dye spots 70 may appear there-upon when contamination occurs. The same may be true for the rim covers 11 described elsewhere herein as well, whereby a dye treatment may result in the appearance of representative dye spots when contaminated.

The invention is not limited to the above-described embodiments and many modifications are possible within the scope of the following claims. Indeed, a person of ordinary skill in the art would be able to use the information contained in the preceding text to modify various embodiments of the invention in ways that are not literally described, but are nevertheless encompassed by the attached claims, for they accomplish substantially the same functions to reach substantially the same results. Therefore, it is to be understood that the invention is not limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. An assembly configured for protecting multiple portions of a toilet assembly from contaminants, the assembly comprising:

a rim cover;

a first mounting assembly positioned adjacent a portion of the rim cover and a rim portion of the toilet assembly, the first mounting assembly being configured to selectively attach and secure at least a portion of the rim cover to the rim portion of the toilet assembly;

a skirt; and a second mounting assembly positioned adjacent a portion of the skirt and a base portion of the toilet assembly, the second mounting assembly being configured to selectively attach and secure at least a portion of the skirt to the base portion of the toilet assembly, wherein either:

(a) the assembly further comprises a front-mount dispenser attached around a portion of the base portion of the toilet assembly, and at least one of the rim cover or the skirt are selectively removable from within the front-mount dispenser for use thereof with the toilet assembly; or (b) the assembly further comprises a side-mount dispenser attached to a portion of the rim portion of the toilet assembly via a hanger bracket, and at least the rim cover is selectively removable from within the side-mount dispenser for use thereof with the toilet assembly.

2. The assembly of claim 1, wherein at least two fold lines are located on the rim cover, such that the rim cover is configured to drape over a top surface, an inner wall, and an outer wall of the rim portion of the toilet assembly.

3. The assembly of claim 1, wherein at least one of the first and second mounting assemblies comprises an adhesive material attached to a portion of the rim cover and the skirt, respectively.

4. The assembly of claim 1, wherein the first mounting assembly comprises a rod positioned adjacent an inner wall of the rim portion, such that the rod is located within an inside bowl of the toilet assembly.

5. The assembly of claim 4, wherein a portion of the rim cover defines an elongate passage sized to receive there-through the rod.

6. The assembly of claim 4, wherein the rod is a tension rod that includes a spring attribute configured to bias the tension rod against the inner wall of the rim portion.

7. The assembly of claim 4, wherein the rod is a non-corrosive loop having opposing ends retained with a retaining mechanism that includes one of a clasp or a hook.

8. The assembly of claim 1, wherein the first mounting assembly comprises a frame positioned adjacent an inner wall of the bowl portion, such that the frame is located within an inside bowl of the toilet assembly.

9. The assembly of claim 8, wherein the frame includes at least one elongate portion and a plurality of leg portions periodically attached to and spaced along the elongate portion, substantially perpendicular to the elongate portion, and extending from the elongate portion toward an inner wall of the bowl portion, such that the frame is offset from the inner wall and located within an inside bowl of the toilet assembly.

10. The assembly of claim 9, wherein the at least one elongate portion comprises two elongate and concentric portions spaced apart relative to one another by a distance equal to a length of each of the plurality of leg portions.

11. The assembly of claim 1, wherein the first mounting assembly comprises a frame positioned adjacent a top rim, an inner wall rim, and an outer wall rim, such that the frame is positioned atop the toilet bowl rim assembly.

12. The assembly of claim 1, wherein at least one of the first and second mounting assembly comprises a rod positioned adjacent a portion of the rim portion and the base portion, respectively, such that the rod is located external to an inside bowl of the toilet assembly.

13. The assembly of claim 12, wherein a portion of at least one of the rim cover or the skirt defines an elongate passage sized to receive there-through the rod.

14. The assembly of claim 12, wherein the rod is a tension rod that includes a spring attribute configured to bias the tension rod against the rim portion.

15. The assembly of claim 12, wherein the rod is a non-corrosive polymer loop having opposing ends retained with a retaining mechanism that includes one of a clasp or a hook.

16. The assembly of claim 12, wherein the portion of the rim against which the rod of the first mounting assembly is positioned is an underside lower rim adjacent the outer wall of the rim portion.

17. The assembly of claim 1, wherein at least one of the first and second mounting assembly comprises an elastic cord or band positioned adjacent a portion of the rim portion and the base portion, respectively, such that the elastic cord or band is located external to an inside bowl of the toilet assembly.

18. The assembly of claim 1, wherein at least one of the first and second mounting assembly comprises an elastic cord positioned adjacent a portion of the underside curved bowl and the base portion, respectively, such that the elastic cord is located external to an inside bowl of the toilet assembly.

19. The assembly of claim 18, wherein the elastic cord includes opposing ends retained with a retaining mechanism that includes one of a clasp or a hook.

20. The assembly of claim 1, wherein at least one of:

at least one of the rim cover or the skirt includes at least one of surface texturing, impregnations, absorption layers, surface coatings, barrier layers, adhesive layers, or dye components; or at least one of the first and second mounting assemblies includes surface features configured to engage and retain the rim cover and the skirt, respectively.

21. The assembly of claim 1, wherein:

the assembly further comprises a floor mat positioned adjacent a floor surface, upon which the toilet assembly is mounted, and around the base portion of the toilet assembly; and at least one portion of the skirt at least partially overlaps a portion of the floor mat.

22. The assembly of claim 1, wherein the rim cover includes the portion of the rim cover secured to the rim portion is a first portion and the rim cover further comprises a second portion covering hinges of a lid and/or seat of the toilet assembly, adjacent the rim portion.

23. The assembly of claim 22, wherein the second portion is integrally formed with the first portion.

24. The assembly of claim 22, wherein the rim cover further comprises a front bib portion opposite the second portion.

25. The assembly of claim 1, wherein the assembly further comprises a seat cover that is selectively attachable to an underside of a seat of the toilet assembly.

26. The assembly of claim 1, wherein the portion of the rim cover secured to the seat bottom portion is configured for covering the hinges and mounts of a seat and lid of the toilet assembly, adjacent the rear rim portion.

27. An assembly configured for protecting multiple portions of a toilet assembly from contaminants, the assembly comprising:

a rim cover;

a first mounting assembly positioned adjacent a portion of the rim cover and a rim portion of the toilet assembly, the first mounting assembly being configured to selectively attach and secure at least a portion of the rim cover to the rim portion of the toilet assembly;

a skirt; and a second mounting assembly positioned adjacent a portion of the skirt and a base portion of the toilet assembly, the second mounting assembly being configured to selectively attach and secure at least a portion of the skirt to the base portion of the toilet assembly, wherein the first mounting assembly comprises a frame positioned adjacent an inner wall of the bowl portion, such that the frame is located within an inside bowl of the toilet assembly.

28. The assembly of claim 27, wherein:

the frame includes at least one elongate portion and a plurality of leg portions periodically attached to and spaced along the elongate portion, substantially perpendicular to the elongate portion, and extending from the elongate portion toward an inner wall of the bowl portion, such that the frame is offset from the inner wall and located within an inside bowl of the toilet assembly; and the at least one elongate portion comprises two elongate and concentric portions spaced apart relative to one another by a distance equal to a length of each of the plurality of leg portions.

* * * * *